US007198422B2

(12) United States Patent
Ng et al.

(10) Patent No.: US 7,198,422 B2
(45) Date of Patent: Apr. 3, 2007

(54) FLEXIBLE STRAP RING BINDER

(75) Inventors: Weng Io Ng, Quarry Bay (CN); Hung Yu Cheng, Siu Lek Yuen (CN)

(73) Assignee: World Wide Stationery Manufacturing Company, Limited, Kwai Chung, N.T. (HK)

( * ) Notice: Subject to any disclaimer, the term of this patent is extended or adjusted under 35 U.S.C. 154(b) by 717 days.

(21) Appl. No.: 10/201,607

(22) Filed: Jul. 23, 2002

(65) Prior Publication Data

US 2004/0018040 A1 Jan. 29, 2004

(51) Int. Cl.
*B42F 13/06* (2006.01)
*B42F 13/10* (2006.01)

(52) U.S. Cl. ..... 402/15; 402/8; 402/19; 402/60; 402/64

(58) Field of Classification Search ..... 402/8, 402/15, 19, 60, 64, 70
See application file for complete search history.

(56) References Cited

U.S. PATENT DOCUMENTS

| | | | | |
|---|---|---|---|---|
| 2,495,180 | A * | 1/1950 | Phillips | 402/22 |
| 2,559,556 | A * | 7/1951 | Ambler | 402/15 |
| 3,315,682 | A | 4/1967 | Bachman | |
| 3,362,412 | A * | 1/1968 | Moller | 402/15 |
| 4,577,985 | A | 3/1986 | Beyer | |
| 4,693,624 | A * | 9/1987 | Moosmuller | 402/22 |
| 4,932,804 | A * | 6/1990 | Richards | 402/75 |
| 5,096,323 | A * | 3/1992 | Walker | 402/62 |
| 5,354,142 | A | 10/1994 | Yu | |
| 5,414,904 | A * | 5/1995 | Sampson | 24/16 PB |
| 5,577,852 | A | 11/1996 | To | |
| 5,618,122 | A | 4/1997 | Constantine | |
| 5,755,513 | A | 5/1998 | To | |
| 5,842,807 | A | 12/1998 | To | |
| 5,879,097 | A | 3/1999 | Cheng | |
| 6,033,144 | A | 3/2000 | Ng et al. | |
| 6,168,339 | B1 | 1/2001 | To | |

* cited by examiner

*Primary Examiner*—Monica Carter
*Assistant Examiner*—Eric A. Gates
(74) *Attorney, Agent, or Firm*—Senniger Powers

(57) ABSTRACT

A ring binder having flexible straps for lacing through holes in loose-leaf items having being bound, each strap having a clasp for clasping the strap to form it into rings of different size.

28 Claims, 34 Drawing Sheets

FLEXIBLE STRAP RING BINDER

BACKGROUND OF THE INVENTION

This invention relates to a ring binder particularly for use in a loose-leaf binder, being especially directed to a ring binder wherein each ring is formed of a flexible strap.

In the background may be noted the following U.S. Patents received by the assignee of this invention:

| U.S. Pat. No. | Date | Title |
|---|---|---|
| 5,354,142 | Oct. 11, 1994 | Ring Binder |
| 5,577,852 | Nov. 26, 1996 | Ring Binder Mechanism |
| 5,755,513 | May 26, 1998 | Ring Binder |
| 5,842,807 | Dec. 1, 1998 | Ring Binder |
| 5,879,097 | Mar. 9, 1999 | Ring Binder |
| 6,033,144 | Mar. 7, 2000 | Ring Binder Mechanism |
| 6,168,339 | Jan. 2, 2001 | Ring Binder |

Also in the background is U.S. Pat. No. 3,315,682, issued Apr. 25, 1967, entitled Loose Leaf Notebook Binder, on account of its showing of a ring formed from a flexible strap. This invention is regarded as involving substantial improvement thereover.

Ring binders generally include metallic ring members which are pivotally connected to a hinge mechanism on a spine for opening and closing opposed ring members. In the open position, the ring members are spaced apart to allow pages of loose-leaf paper or the like which have pre-formed holes to be received on one set of ring members. In the closed position, the opposed ring members are engaged to form a continuous ring on which the pages can be turned. Typically, the ring members and rings which they form have a fixed size and cannot be adjusted in accordance with the amount of paper being held by the ring binder. Consequently, the ring members may be either too small or too large.

BRIEF SUMMARY OF THE INVENTION

Among the several objects of the invention may be noted the provision of a ring binder having a plurality of ring-forming constituents each comprising a flexible strap adapted to be laced through holes in loose-leaf items to be bound and readily formed into a ring; the provision of such a binder adapted for ready manipulation to form rings of different sizes with the rings readily variable in size; the provision of such a binder wherein the rings, after having been formed and closed, may be readily opened; the provision of such a binder which is lightweight; and the provision of such a binder of decidedly economical construction and convenience in use.

In general, a ring binder of the present invention has a plurality of ring-forming constituents each comprising a flexible strap having a clasp at one end. The strap extends from the clasp and has a free end portion. The strap is adapted to have its free end portion laced through holes in loose-leaf items to be bound and formed into a ring by inserting the free end portion in the clasp for holding it in the clasp.

In another aspect, a ring binder of the invention comprises an elongate bar constituting a spine of the ring binder. The bar has an upper face and is provided with holes for receiving fasteners for fastening it in a loose-leaf binder. A plurality of ring-forming constituents are mounted on the bar spaced along its length each comprising a flexible strap having a clasp at one end. Each clasp is seated in a recess in the upper face of the bar. Each strap extends from the clasp away from one side of the bar and has a free end portion. The ring binder is adapted to have the flexible straps laced through holes in loose-leaf items to be bound and formed into a ring by inserting the free end portion in the clasp for holding it in the clasp.

In yet another aspect, a ring binder of the invention comprising an elongate spine having first and second sides and holes for receiving fasteners for fastening the spine in a loose-leaf binder. A plurality of ring-forming constituents are carried by the spine at spaced intervals along its length each comprising a flexible strap having a clasp at one end. Each clasp is situated generally within the spine with the respective strap extending from the clasp through an opening in the second side of the spine. The strap has a free end portion adapted to be laced through holes in loose-leaf items to be bound and formed into a ring by inserting the free end portion through a hole in the first side of the spine and thence through the clasp for being held in the clasp.

In still a further aspect, a ring binder of the invention comprises a spine and a plurality of ring-forming constituents carried by the spine at spaced intervals along its length each comprising a flexible strap having a clasp at one end. Each clasp is situated with the respective strap extending from the clasp. The strap has a free end portion adapted to be laced through holes in loose-leaf items to be bound and formed into a ring by inserting the free end portion through the clasp for being held in the clasp. The clasp comprises a pawl engageable with the strap for holding the strap in the clasp. The pawl has a lever for moving the pawl between an engaged position holding the strap and a disengaged position releasing the strap.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
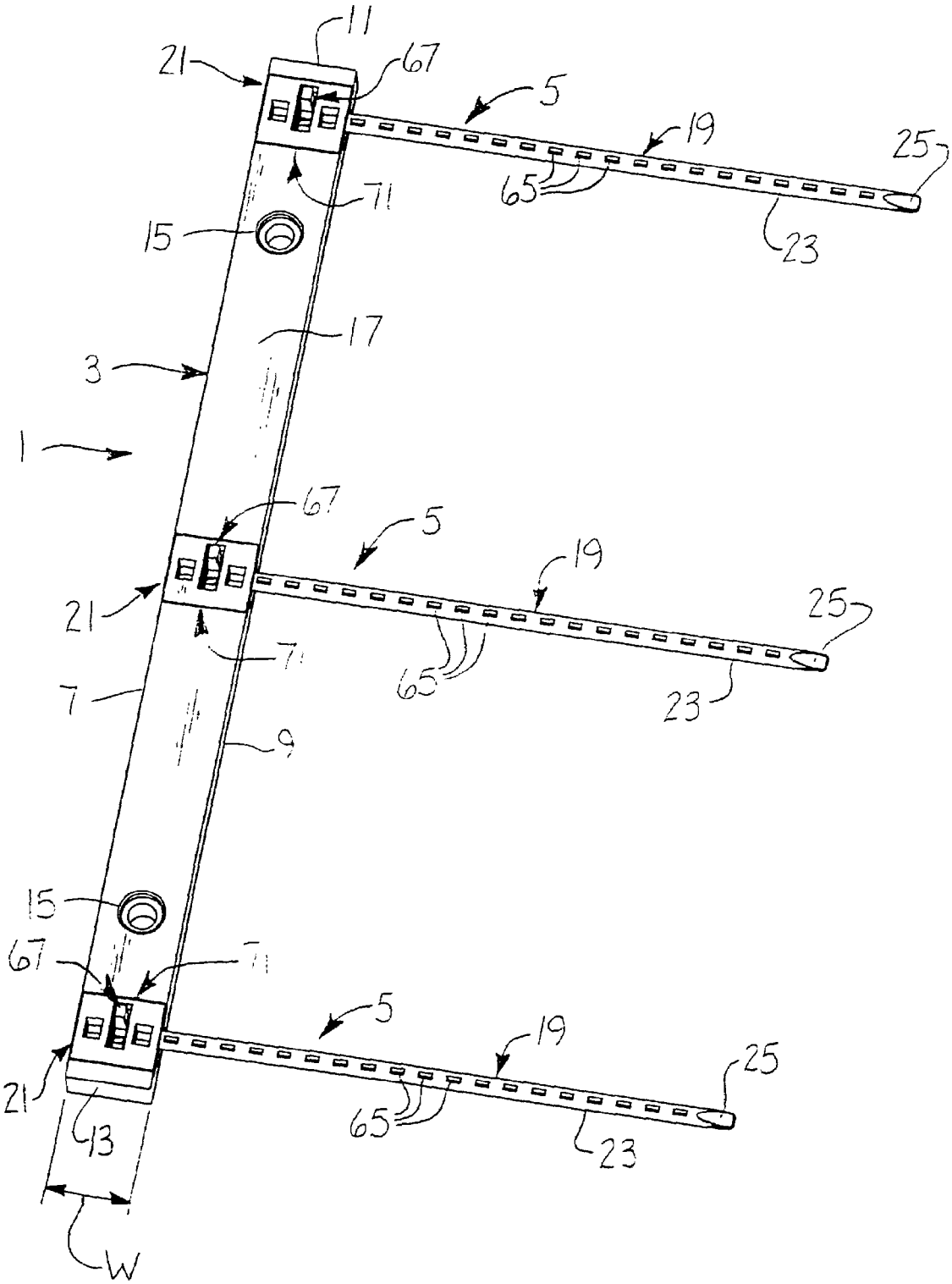
FIG. 1 is a perspective of a ring binder of the invention before forming the rings.
Figure 2:
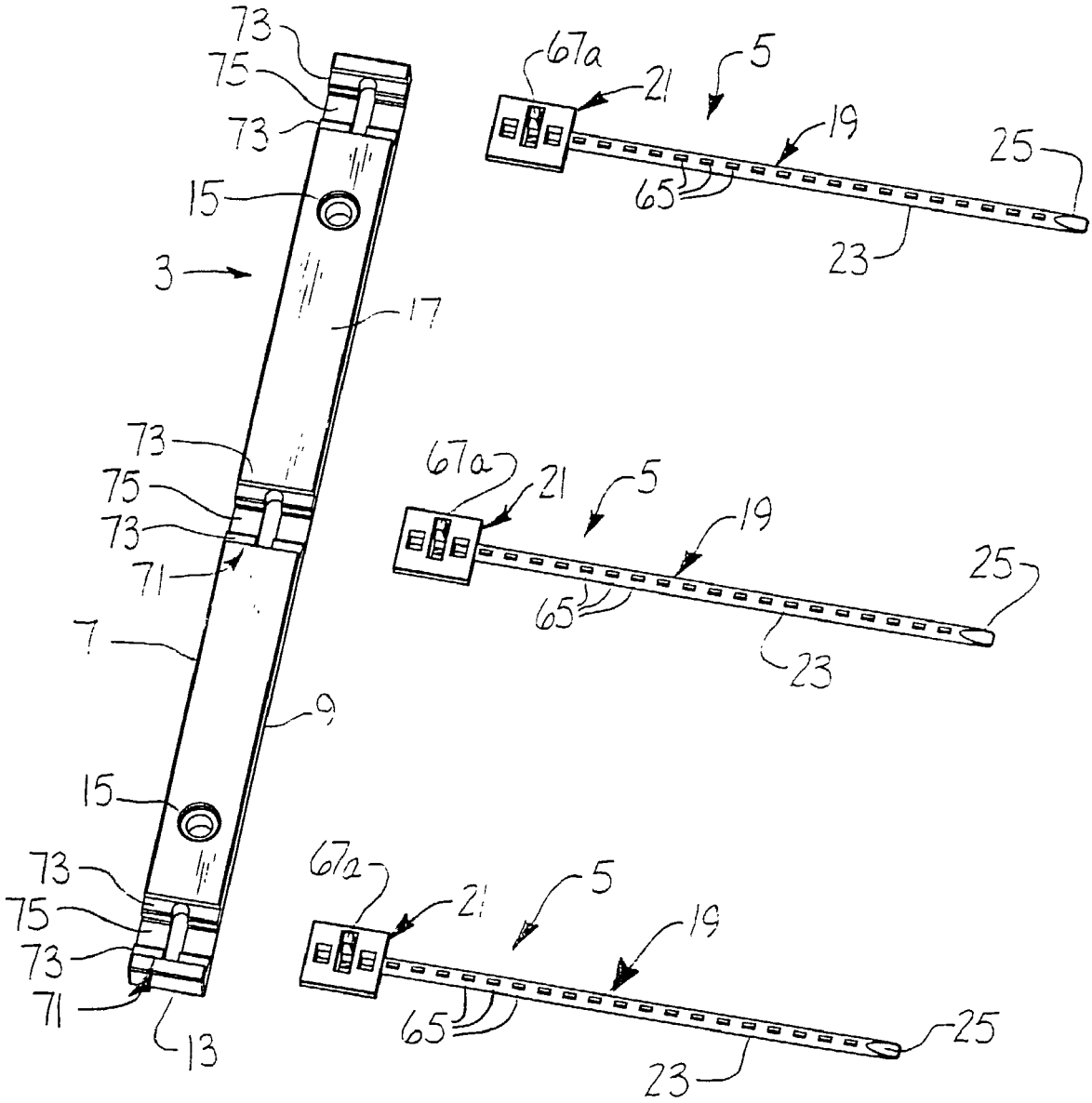
FIG. 2 is an exploded version of FIG. 1.
Figure 3:
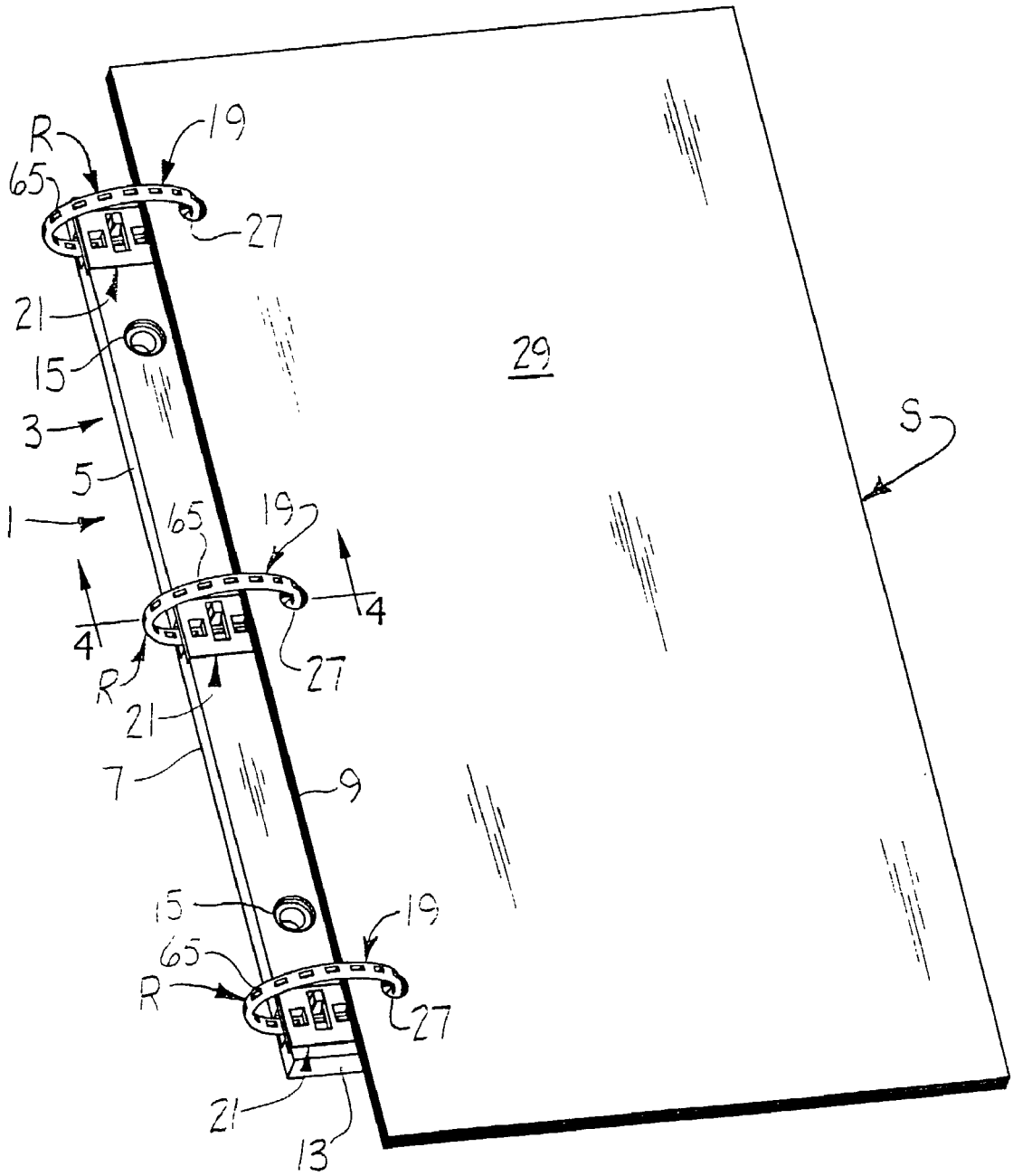
FIG. 3 is a perspective showing the rings formed and binding a sheaf of loose-leaf pages.

Referring particularly to FIGS. 1–3, a first ring binder of this invention, designated 1 in its entirety, is shown to comprise an elongate base or spine 3 having a plurality of ring-forming constituents, each designated 5 in its entirety, mounted thereon spaced at intervals along its length. The base or spine 3 comprises a generally rigid bar of a suitable plastic, such as nylon, polyethylene, a fluorine based resin such as PFA or PTFE, or another resin such as PEEK or PBT. The base 3 has a rectangular cross-section having opposite sides designated 7 and 9 and opposite ends designated 11 and 13. It has holes 15 for receiving suitable fasteners for fastening it in a loose-leaf binder extending heightwise with respect to the loose-leaf binder for holding a sheaf 5 (see FIGS. 3–5) of loose-leaf items. As such, sides 7 and 9 may be denoted the left and right sides and ends 11 and 13 may be denoted the upper and lower ends. The upper face of the base 3 (spine or bar) is specially designated 17.

As shown, the ring binder 1 has three of the ring-forming constituents 5, one adjacent the upper end 11 of the base 3, one in the middle of the base, and one adjacent the lower end 13 of the base. The number, however, is subject to variation. Each of the ring-forming constituents comprises a flexible strap 19 (shown as an elongate member of generally elliptical cross-section) having a clasp 21, more particularly a buckle, at one end (its left end as shown in FIGS. 1 and 2). The strap extends to the right from the clasp 21 (the buckle) and has a free end portion 23 ending with a tapered end 25. As will be subsequently developed, the strap 19 is adapted to have its free end portion 23 laced through holes 27 in loose-leaf items 29 to be bound and formed into a ring R by inserting said free end portion 23 in the clasp 21 for holding it in the clasp.

The free end portion 23 of the strap 19 is insertable to different positions in the clasp 21 for forming rings R of different size (different diameter). The clasp 21 holds the strap against retrograde movement, i.e. against being backed off or pulled out of the clasp, from any inserted position of the free end portion in the clasp.

Figure 20:
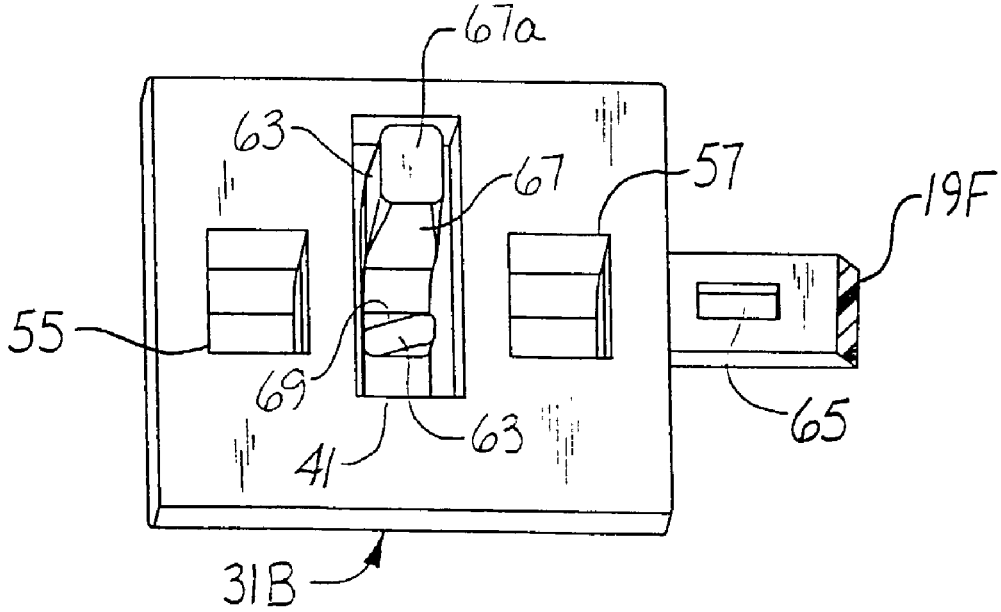
FIG. 20 is a perspective showing another modification having a flat strap.

As above noted, the clasp 21 comprises a buckle likewise designated 21 in its entirety. The buckle comprises a body 31 in the form of a rectangular frame having opposite sides designated 33 and 35 and opposite ends designated 37 and 39 bounding a slot-like opening 41 extending laterally in the frame, positioned between sides 33 and 35. As illustrated, end 37 is at the left, end 39 is at the right. The left end 37 may be denoted the rearward or strap entry end of the buckle 21, the right end may be denoted the forward or strap exit end of the buckle. The strap 19 extends generally from the center of the forward (i.e. the right or strap exit) end. While the strap 19 is shown as of generally elliptical cross-section it could be of other cross-sections; more particularly it could be flat as shown in FIG. 20 with a pointed end (more on this later). The body or frame 31 of the buckle 21 has a length L (from end 37 to end 39) generally equal to the width W of the base or spine 3.

Figure 6:
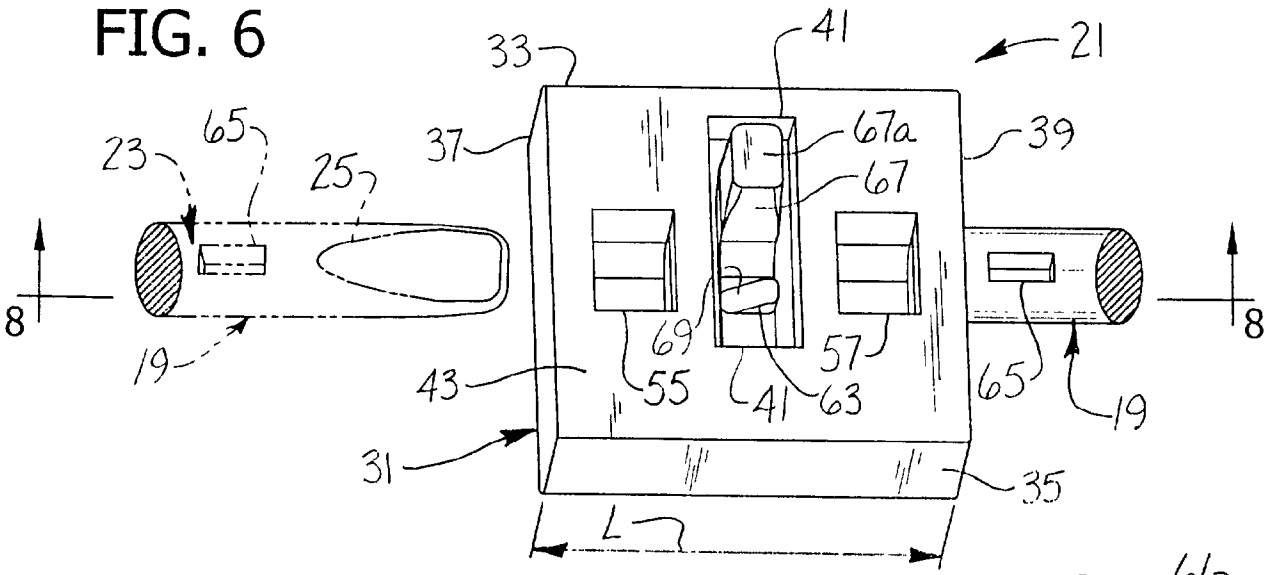
FIG. 6 is an enlarged fragment of FIGS. 1 and 2 showing a clasp component, more particularly a buckle, as viewed from the top, and showing the leading end of a strap in phantom.

At 43 and 45 (FIGS. 6 and 7) are indicated what may be regarded as the top and bottom, respectively, of the buckle body or frame 31. Extending down from the bottom 45 are strap guides 47 and 49, the guide 47 being located adjacent the rearward end 37 of the buckle between the rearward end 37 and the slot 41, the guide 49 being located adjacent the forward end 39 of the buckle between the slot 41 and the forward end 39. Each guide comprises a generally U-shaped protuberance; the opening in the guide 47 being designated 51, the opening in the guide 49 being designated 53. The opening 51 constitutes a rearward guide opening for entry of strap 19 in the buckle, and opening 53 constitutes a forward opening for exit of the strap from the buckle. The buckle body or frame 31 has openings 55, 57 above the guides.

Figure 5:
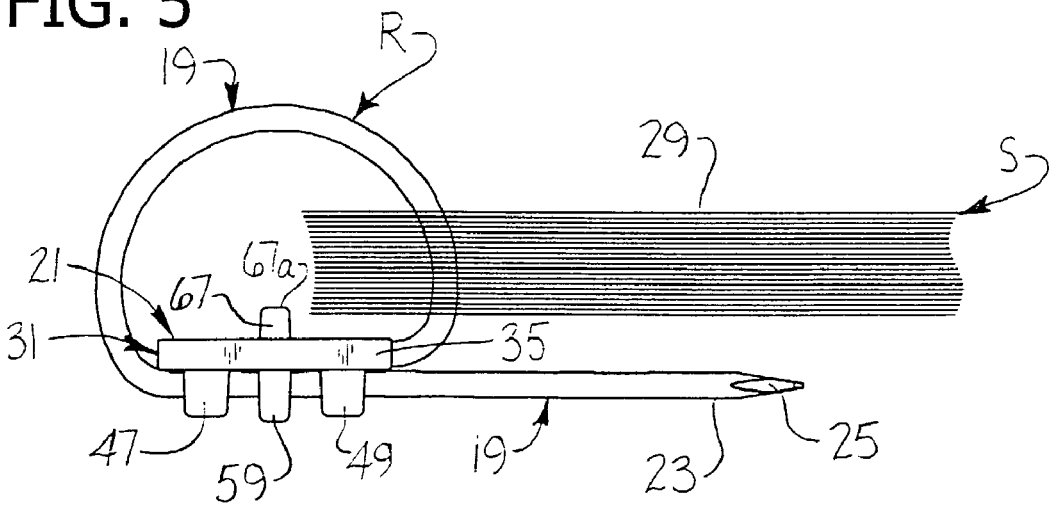
FIG. 5 is generally an end view of FIG. 3 showing the ring in a relatively small size binding a smaller sheaf than shown in FIG. 4.
Figure 7:
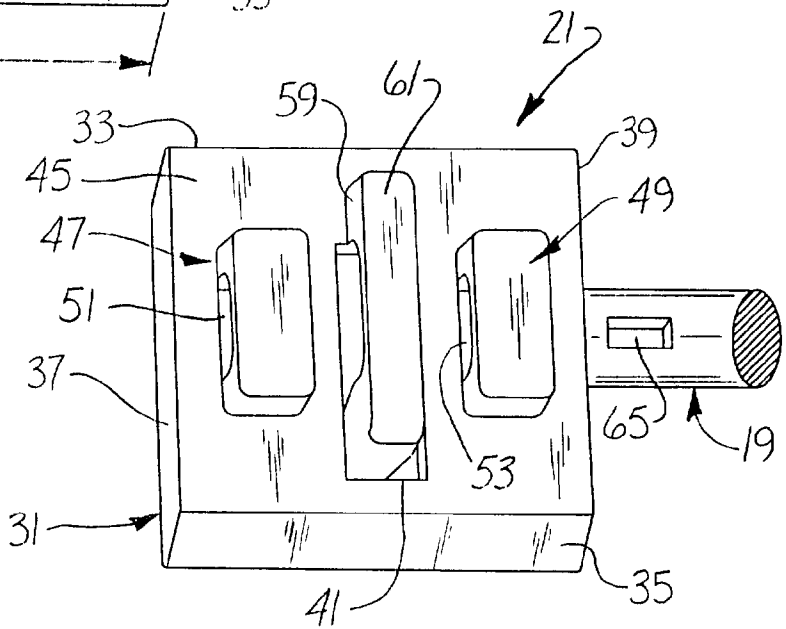
FIG. 7 is a perspective of the FIG. 6 clasp (buckle) as viewed from the bottom.
Figure 10:
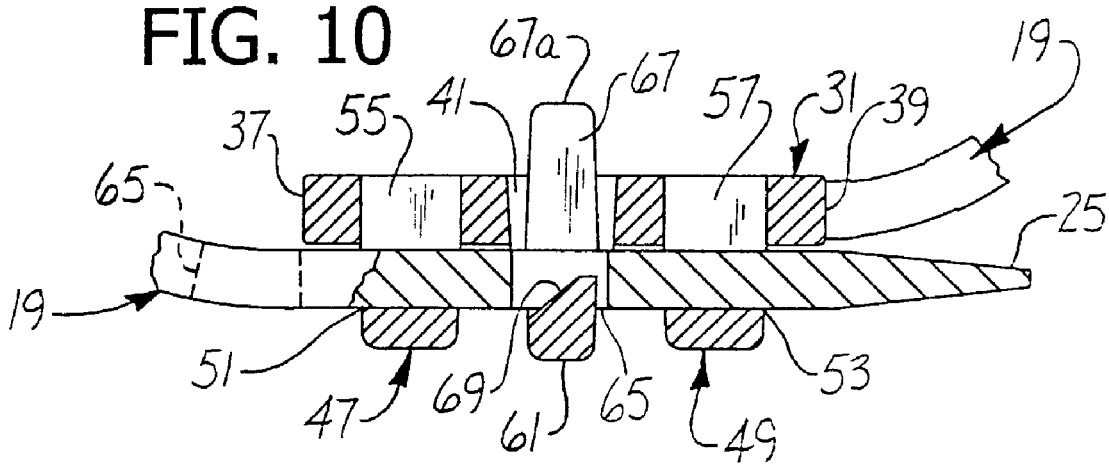
FIG. 10 is a development of FIG. 9 showing the strap further inserted and held against retrograde movement.
Figure 10A:
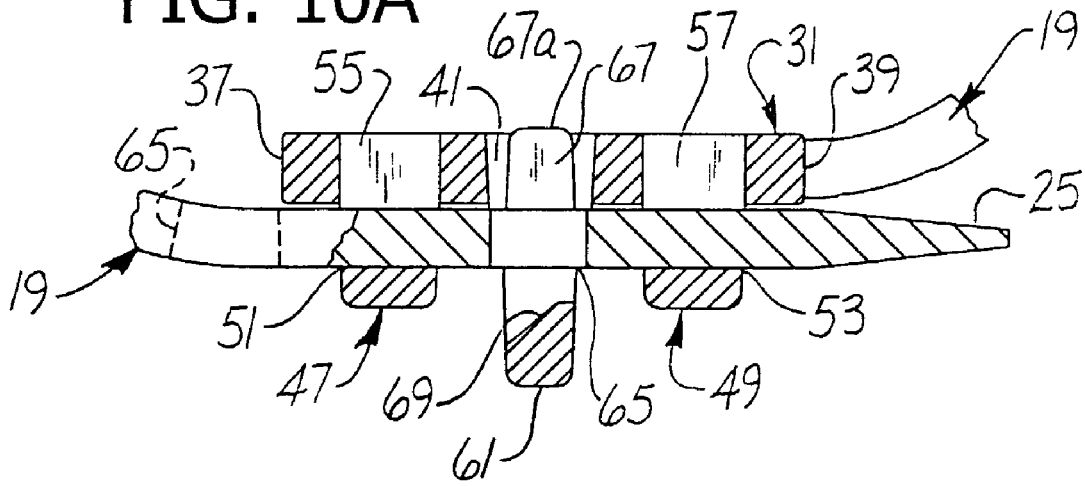
FIG. 10A is a view corresponding to FIG. 9 showing release of the strap for retrograde movement.
Figure 11:
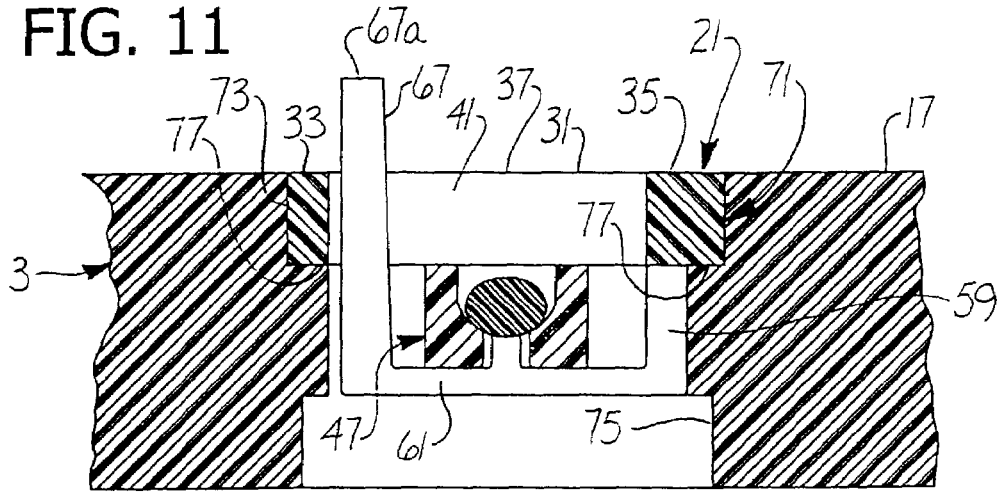
FIG. 11 is a view in section taken generally on line 11—11 of FIG. 9 including a showing of the spine of the ring binder.
Figure 12:
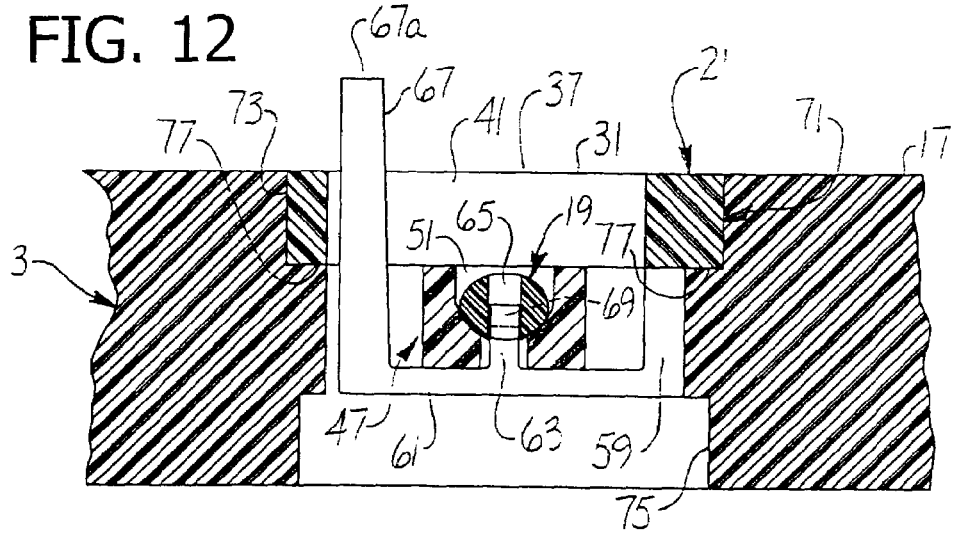
FIG. 12 is a view corresponding to FIG. 11 showing the strap in the FIG. 10 situation.
Figure 13:
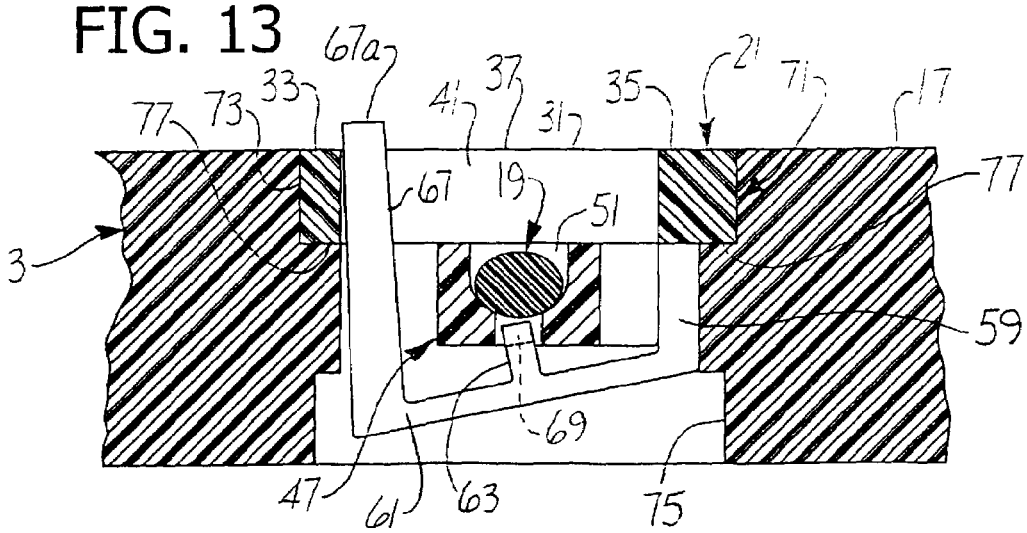
FIG. 13 is a view corresponding to FIG. 12 showing release of the strap (as in FIG. 10A)

Extending down from the buckle body or frame 31 at an end of the slot 41 is a lug 59 (FIGS. 5 and 7). Cantilevered from adjacent the lower end of the lug is a resiliently acting arm 61 (which may also be denoted the tongue of the buckle). On arm or tongue 61 generally centrally of its length is a detent or tooth 63 (FIGS. 6 and 8) adapted for entry in any one of a series of detent or tooth-receiving holes 65 in the strap 19 spaced at intervals along its length. The resiliently acting arm or tongue 61 is bendable down away from the original unbent position shown in FIG. 11 to a bent position such as shown in FIG. 13. Extending up from the resiliently acting arm or tongue 61 at its end, which is free for bending down of the arm or tongue, is a depressor 67 for depressing the arm or tongue, i.e. for bending it down. The depressor 67 extends up in slot 41 to a level above the top 43 of the buckle body or frame 31 for application of a user's finger to its upper end 67*a* to press it down and thereby bend the arm or tongue 61 down. The detent or tooth 63 has a wedging or camming slanting surface 69 for engagement by the tapered leading end 25 of the strap 19 on the insertion of the strap in the clasp or buckle 21 to cam (bend) the resiliently acting arm or tongue down to the position shown in FIGS. 10A and 13, out of the strap's way.

Each ring-forming constituent 5 is preferably made of plastic such as nylon, polypropylene, or polyethylene, which lends itself to the resilient action of the arm or tongue 61 of the buckle 21. The strap 19 may be produced separately from the clasp or buckle 21 and suitably bonded thereto, or the strap and the clasp or buckle may be molded of the stated plastic in one piece (the strap then being integral with the buckle). The holes 55, 57 are formed in the molding process.

Figure 2A:
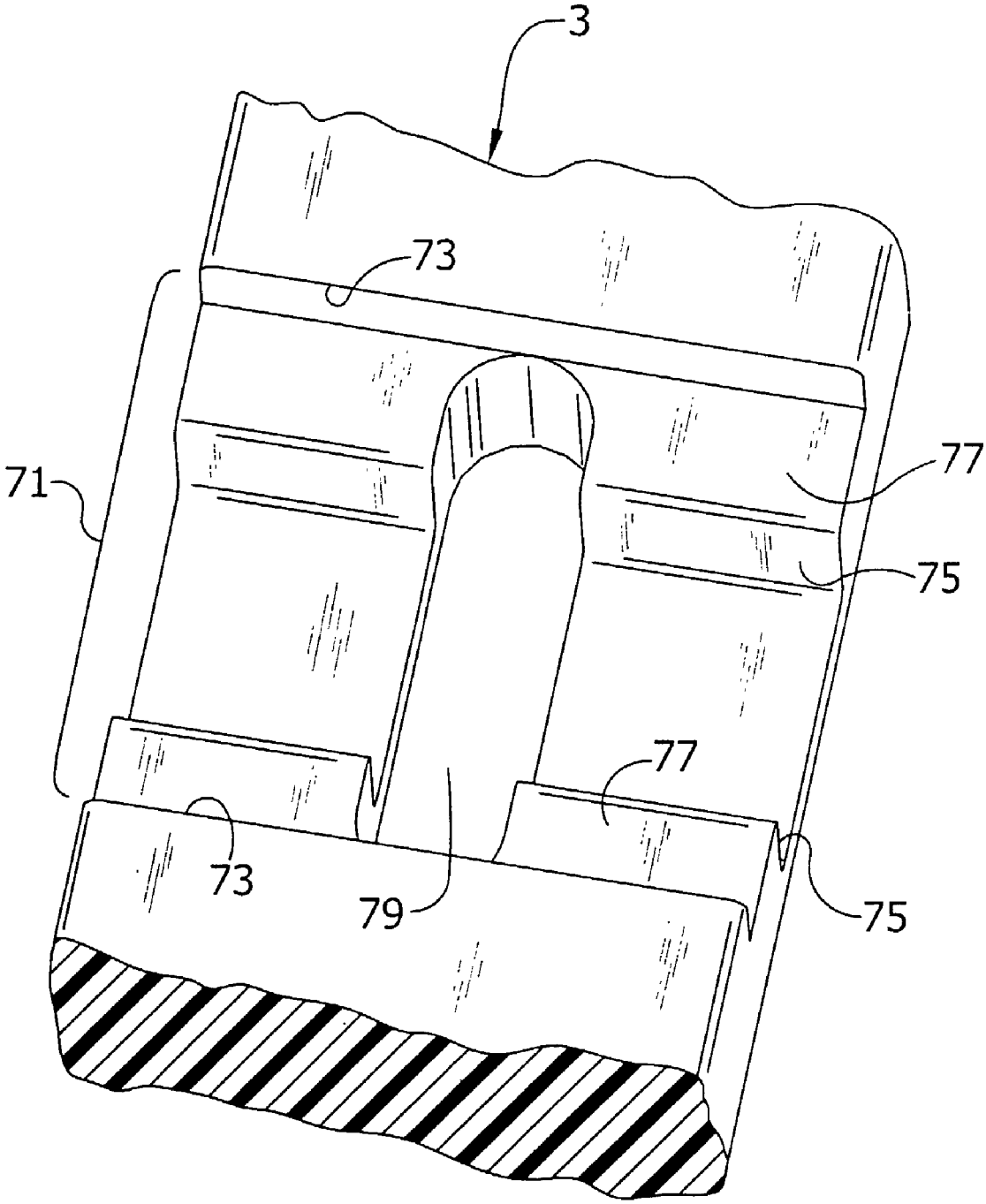
FIG. 2A is an enlarged fragment of FIG. 2.

Each ring-forming constituent 5 has its buckle 21 seated in a recess generally designated 71 (FIGS. 2 and 2A) in the base or spine 3 which extends transversely across the spine 3, the buckle being suitably secured therein as by being bonded thereto by a suitable adhesive. The recess has an upper part 73 having a width for fitting the buckle therein widthwise and a lower narrower part 75 receiving the strap guides 47, 49. Opposite side margins of the buckle are seated on the upwardly facing shoulders 77 which are thereby formed at opposite sides of the recess. The base or spine 3 has a transversely extending slot 79 in the bottom of each recess 71 for reception of the respective arm 61 as it bends down (see particularly FIGS. 2A and 11–13).

Figure 4:
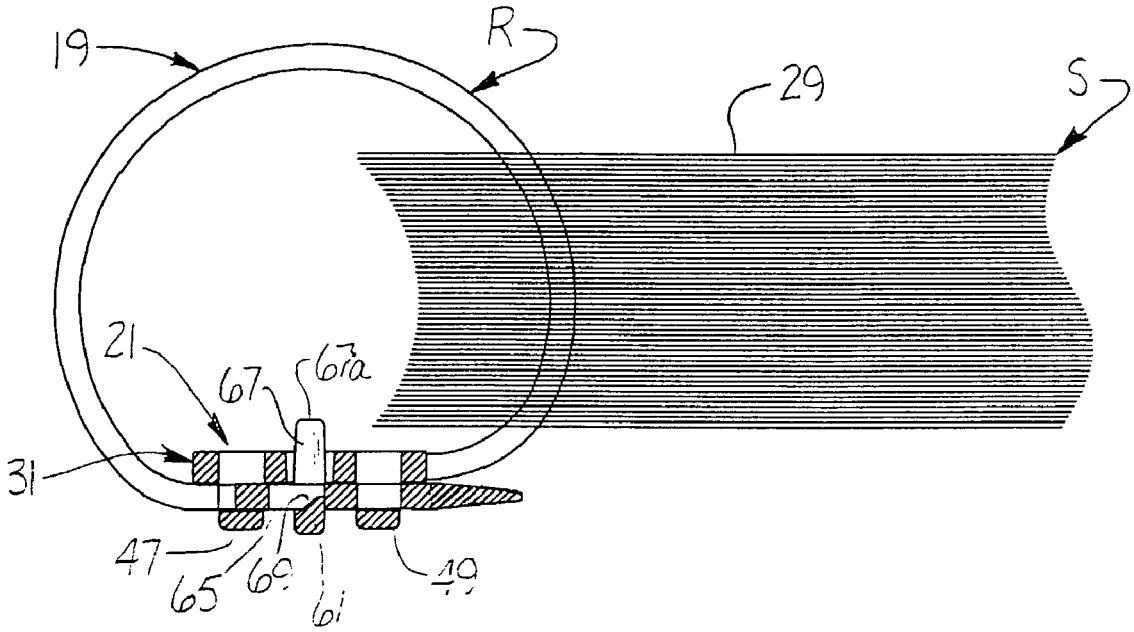
FIG. 4 is a view generally in section on line 4—4 of FIG. 3 showing the ring in a relatively larger size binding a relatively thick sheaf of loose-leaf pages.
Figure 8:
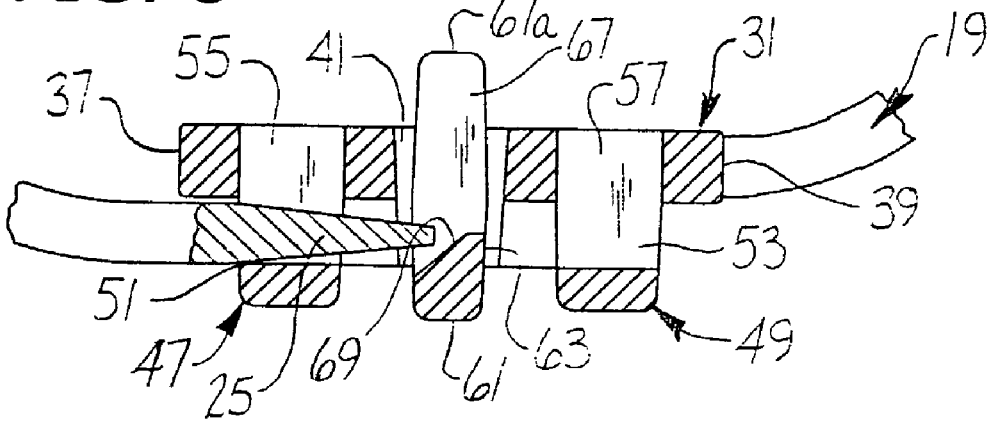
FIG. 8 is an enlarged view in section taken generally on line 8—8 of FIG. 6 showing the strap partially inserted in the clasp (buckle) and showing a slanting surface of a detent somewhat differently than FIG. 6 for clarity.
Figure 9:
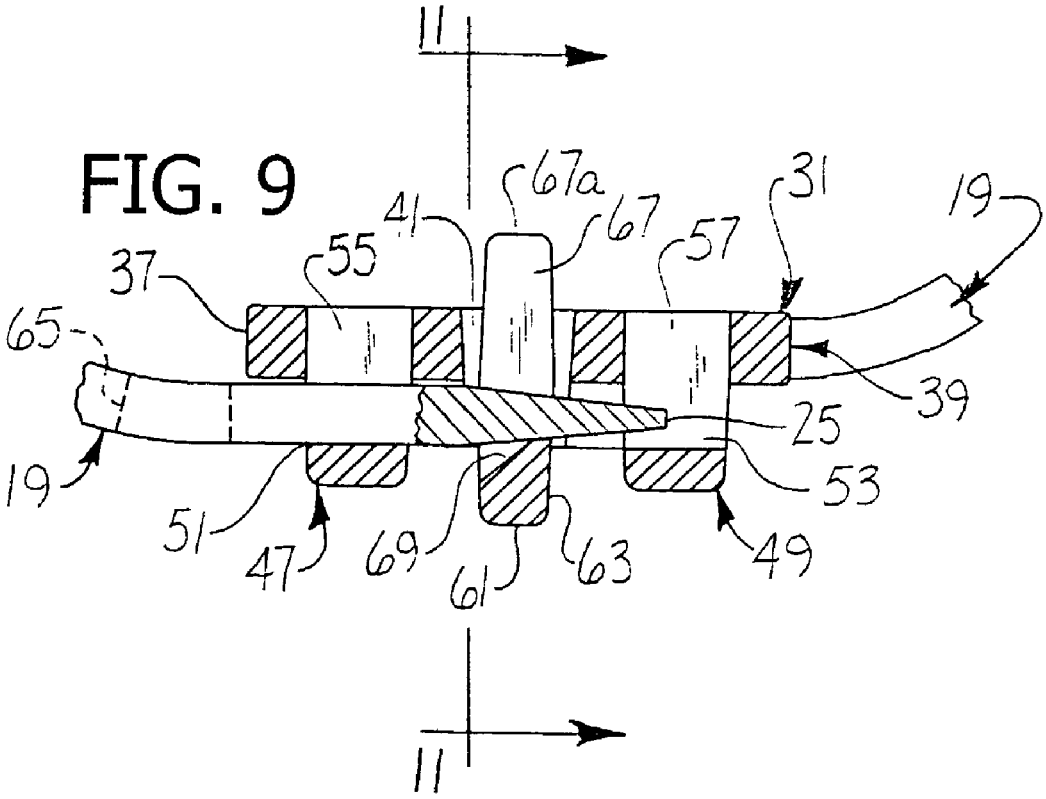
FIG. 9 is a view corresponding to FIG. 8 showing the strap further inserted.
Figure 14:
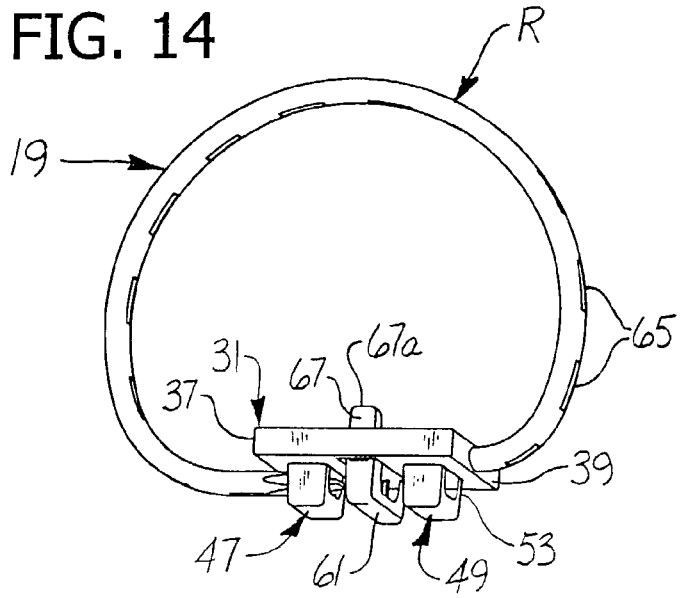
FIG. 14 is a perspective showing the leading end of the strap in a trailing guide of the clasp (buckle)
Figure 15:
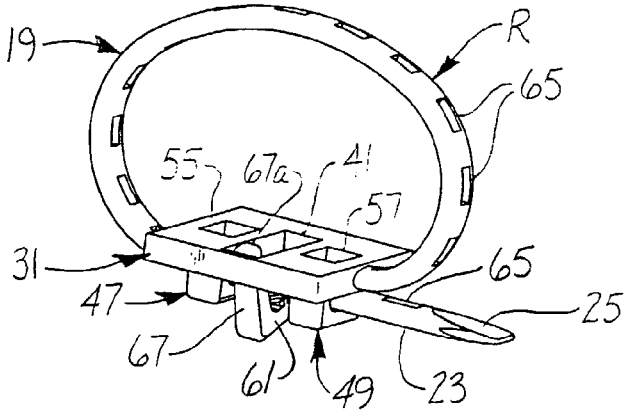
FIG. 15 is a perspective showing the strap passing all the way through the clasp (buckle) and illustrating how the strap is released.
Figure 16:
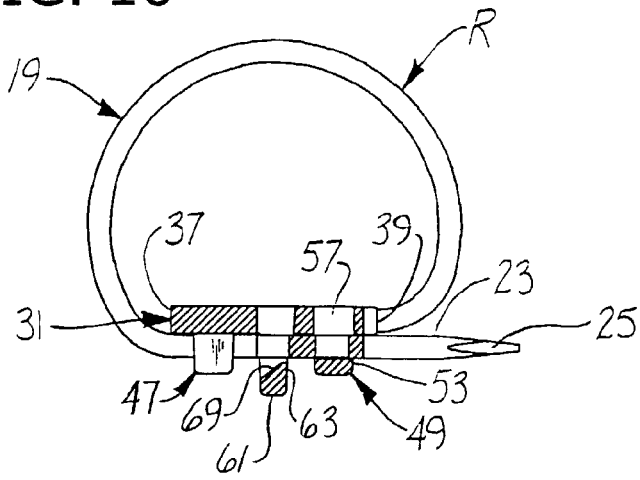
FIG. 16 is an elevational view of the ring, partially in section, as shown in FIG. 15 with the clasp (buckle) manipulated for the release of the strap.
Figure 17:
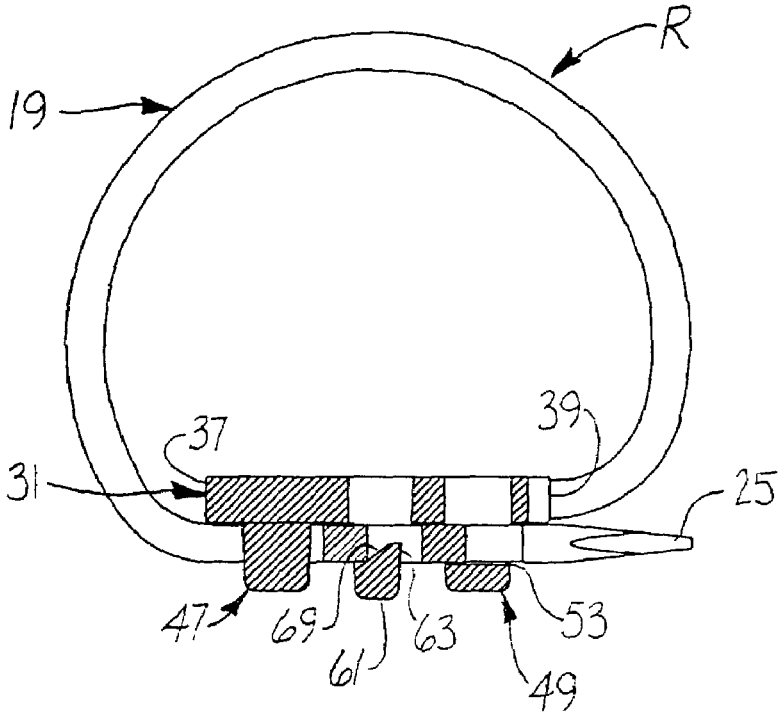
FIG. 17 is a view like FIG. 16 generally illustrating how the strap is held against retrograde movement from its FIG. 16 position.
Figure 18:
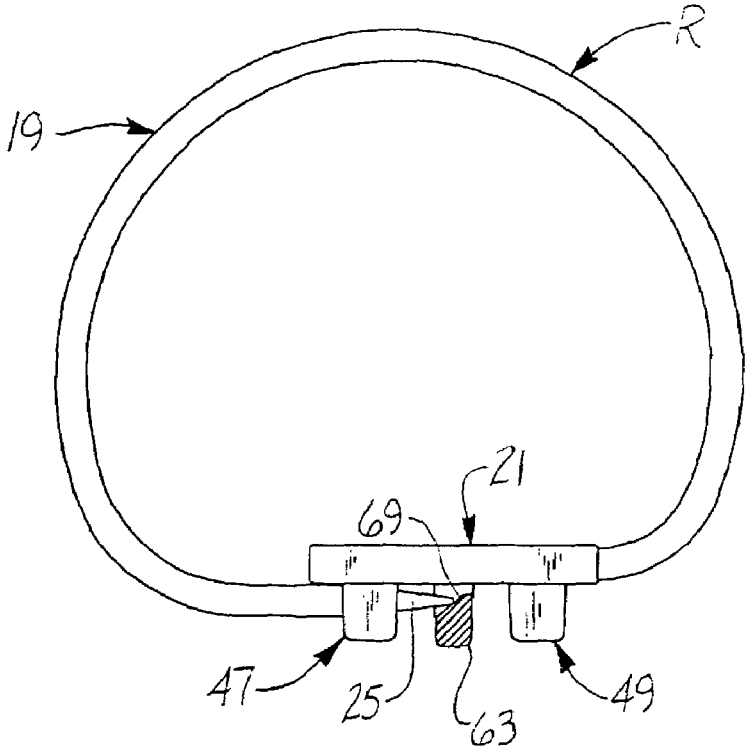
FIG. 18 is a view showing the strap backed off from its FIG. 17 position.

FIGS. 8, 14 and 18 show the tapered leading end 25 of the strap 19 entered in the buckle 21, more particularly entered in the guide opening 51 in guide 47 with end 25 about to engage the slanting surface 69 of the detent 63 following the lacing of the strap through the holes 27 in a loose-leaf item and forming of the strap into a ring. On further forward movement of the strap, it engages the slanting surface 69 of the detent and thereby cams the arm 61 down to its bent position as appears in FIGS. 9 and 13. Alternatively, the arm 61 may be bent down by pressing the depressor 67. The strap is then fed through the guide opening 53 in the guide 49 to the point where the detent 63 registers with an opening 65 in the strap and arm 61 bends back up to its unbent position for entry of the detent in the opening 65. The detent then holds the strap in position establishing the ring R in a size depending on which strap opening 65 the detent is made to enter. FIGS. 5 and 16 illustrate a relatively small ring size; FIGS. 4 and 17 illustrate a larger size.

Figure 19:
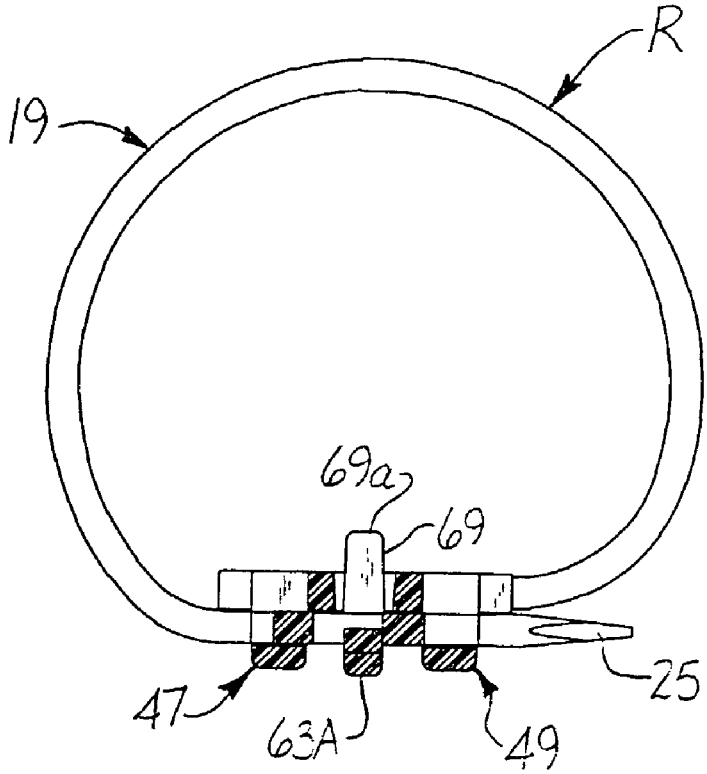
FIG. 19 is a view similar to FIG. 17 showing a modified version of the ring binder having a flat detent.

It will be observed that the detent 63 with the slanting surface 69 precludes retrograde (reverse) movement of the strap 19 while permitting forward movement for decreasing the ring size via the camming down of arm 61, pushing down the depressor 67 not being necessary. The depressor may be pushed down for forward movement of the strap, however, if so desired. FIG. 19 illustrates a modification of the above essentially identical thereto except that the detent, here designated 63A, is generally planar without the slanting camming surface 69. It thereby precludes forward movement of the strap 19 unless pushed down as well as retrograde movement.

FIG. 20 shows a modification with a generally flat strap 19F instead of the strap 19. Here the buckle body or frame is made thinner and the strap guides are modified to have generally flat guide openings. The strap could also be free of holes but have spaced ratchet teeth as for the modification discussed below.

Thus, the invention provides advantages of having rings which are readily and conveniently adjustable in size in accordance with the quantity of loose-leaf items. The material forming the rings and the spine has a lower weight and lower cost than conventional metallic materials.

FIGS. 21–46 illustrate a further modification of the ring binder of this invention, designated 101 in its entirety to distinguish it from the ring binder 1 et al. The ring binder 101 comprises an elongate base or spine 103 having a plurality of ring-forming constituents, each designated 105 in its entirety, mounted thereon at spaced intervals along its length. The base or spine 3 comprises a generally rigid elongate sheet metal bar of inverted channel formation in transverse cross-section, thereby having a top web 107, downwardly extending side flanges 109 and 111. It has upper and lower end formations each designated 113, each of these being formed with a tab 115 having a hole 117 therein for receiving a suitable fastener F for fastening it in a loose-leaf binder generally designated B in FIG. 23 extending heightwise with respect to the loose-leaf binder for holding a sheaf S (see FIGS. 23, 44 and 45) of loose-leaf items. Flanges 109 and 111 are at what may be denoted the left and right sides of the spine. The ring-forming constituents 105 are made of the same plastic as the ring-forming constituents 5. Ring binders having parts made of other materials do not depart from the scope of this invention.

Figure 21:
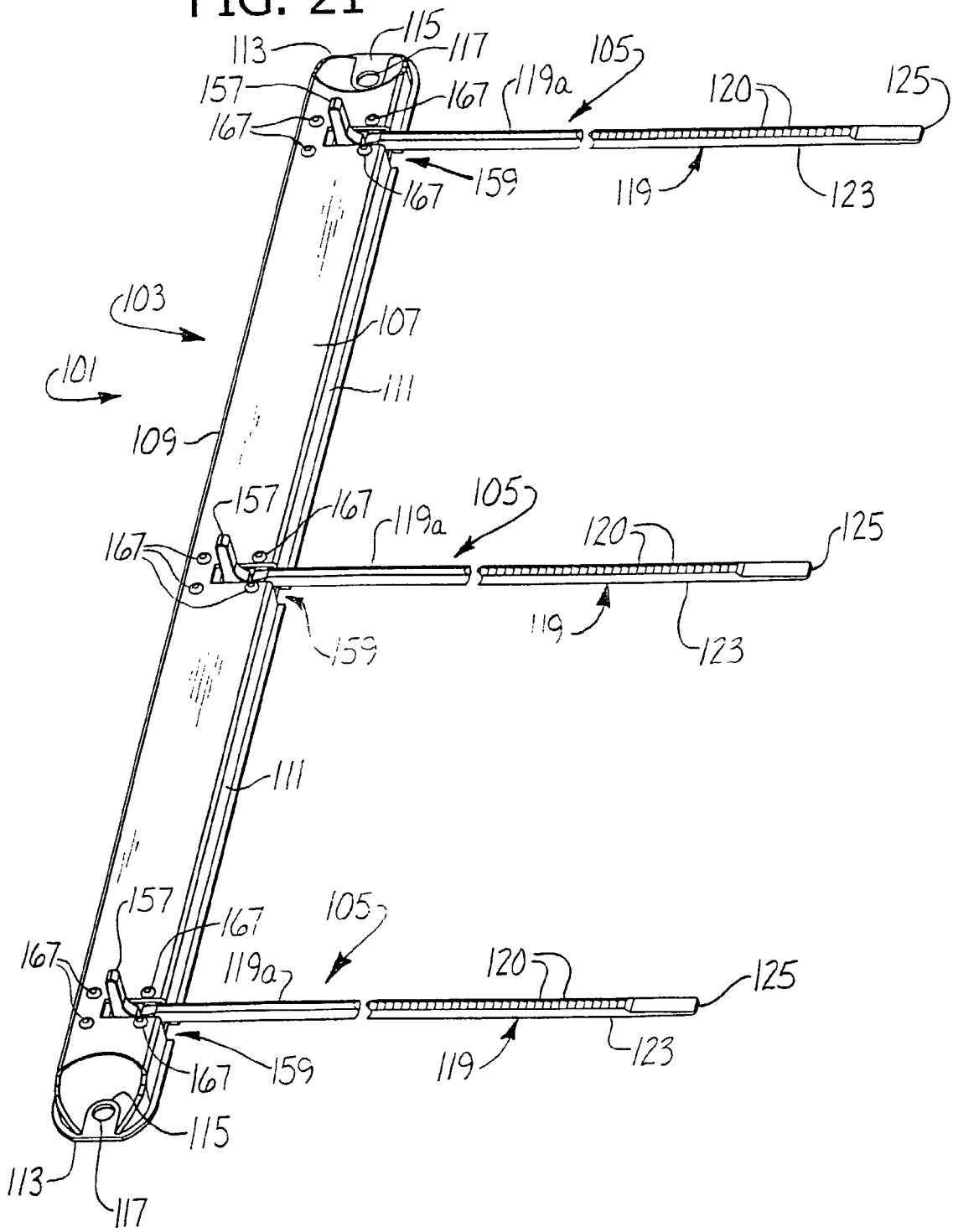
FIG. 21 is a perspective of a further modification of the present invention, shown before forming the rings (as in FIG. 1)
Figure 22:
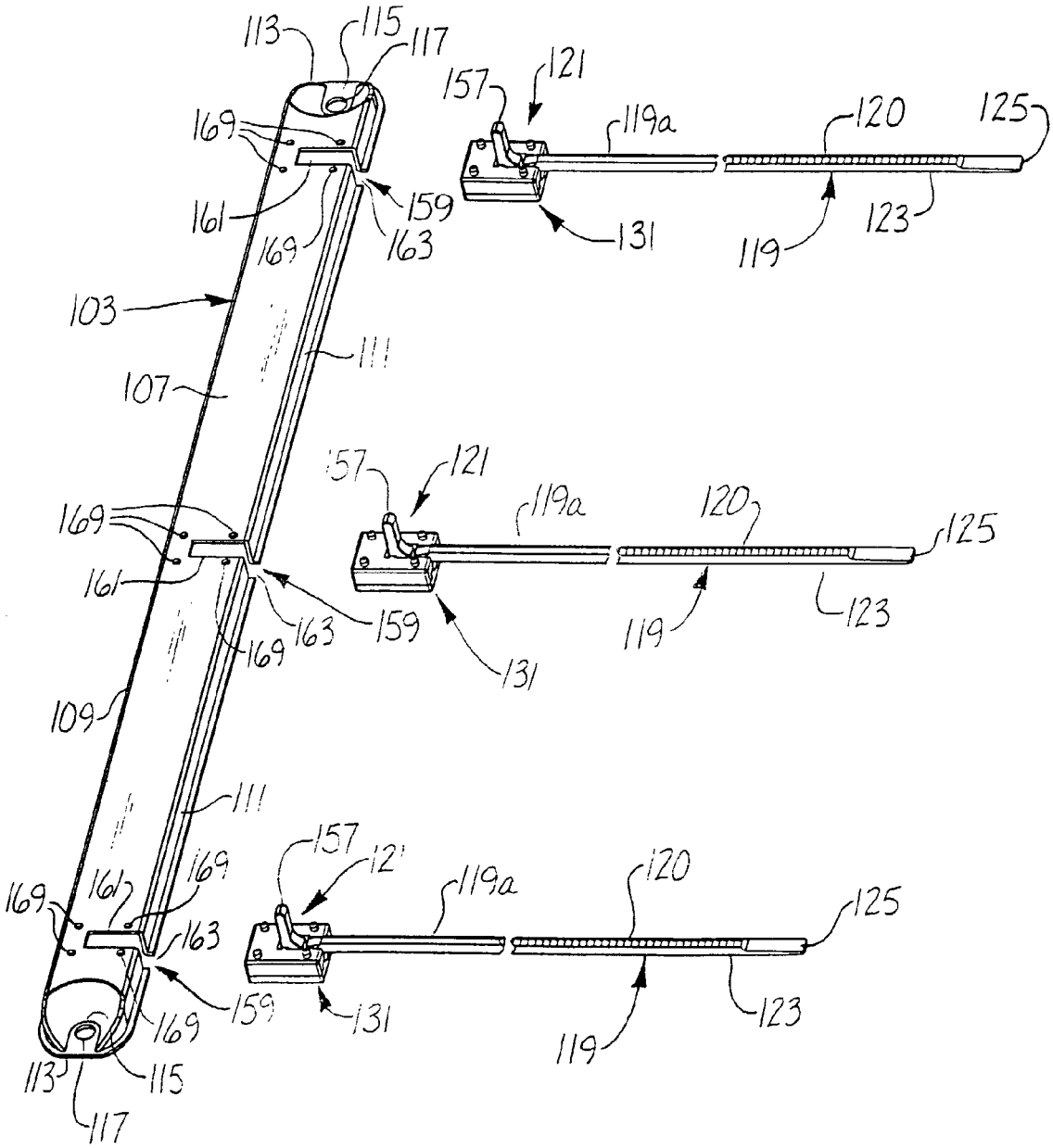
FIG. 22 is an exploded version of FIG. 21.
Figure 23:
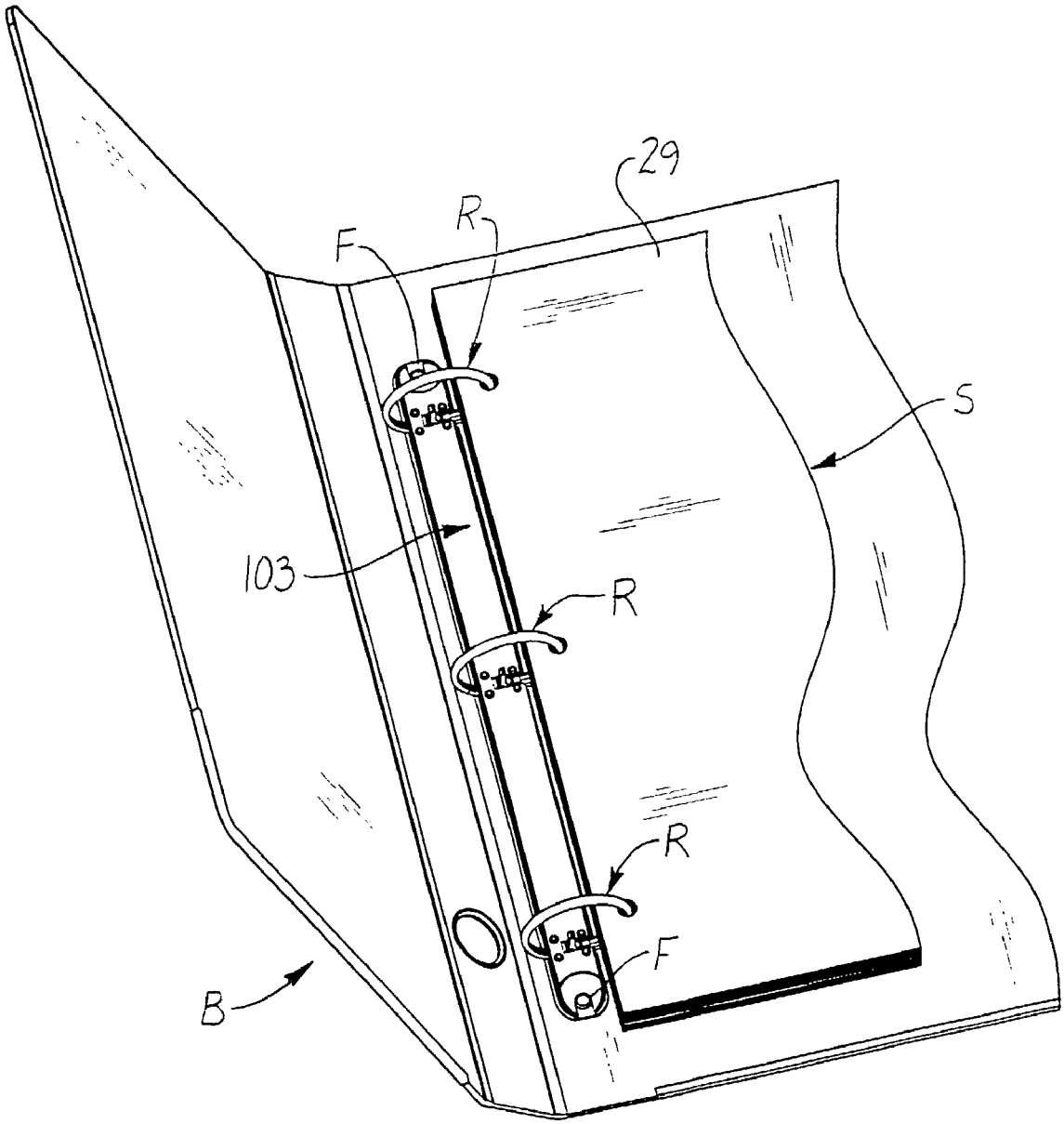
FIG. 23 is a perspective showing the FIG. 21 ring binder with the rings formed and binding a sheaf of loose-leaf pages in a binder, broken away in part.
Figure 24:
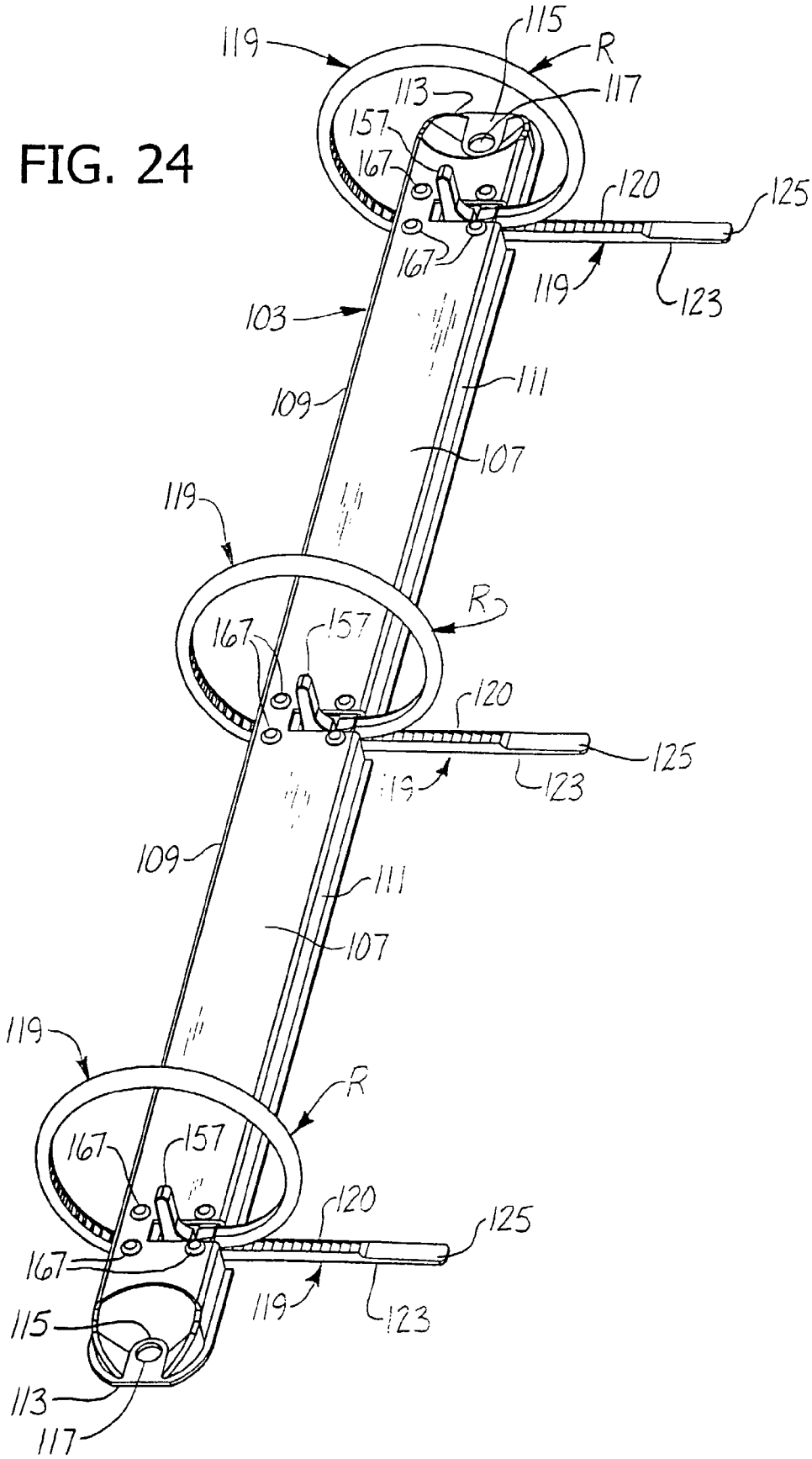
FIG. 24 is a perspective of the FIG. 21 ring binder per se showing the rings formed.
Figure 25:
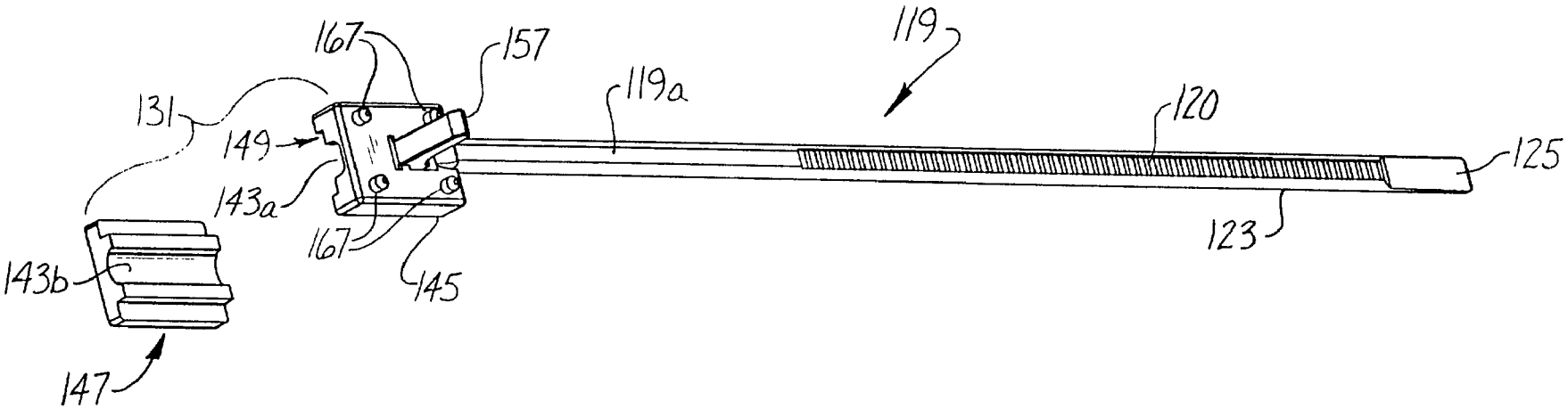
FIG. 25 is an exploded perspective of a ring-forming constituent per se of the FIG. 21 ring binder.
Figure 26:
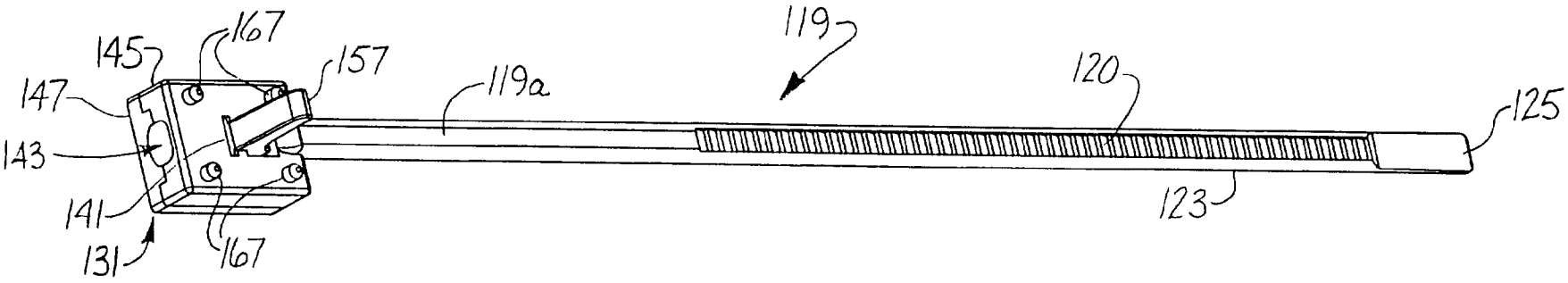
FIG. 26 is a perspective of the ring-forming constituent per se of the FIG. 21 ring binder as viewed from what may be regarded as the top thereof.
Figure 27:
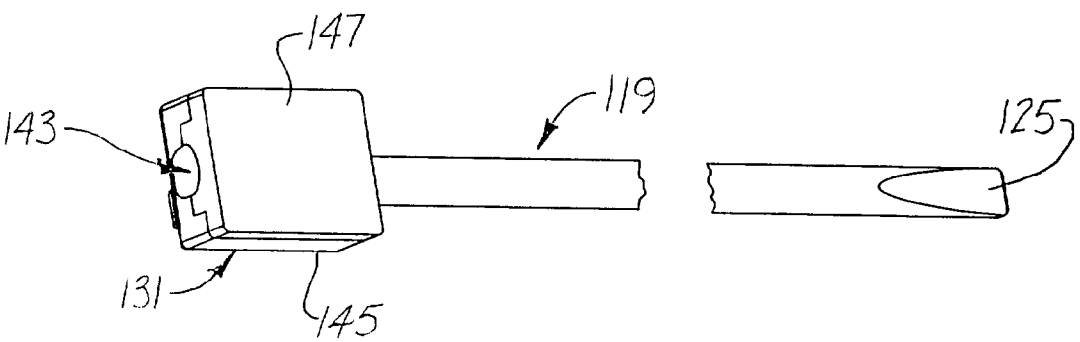
FIG. 27 is a fragmentary bottom perspective of FIG. 26.
Figure 28:
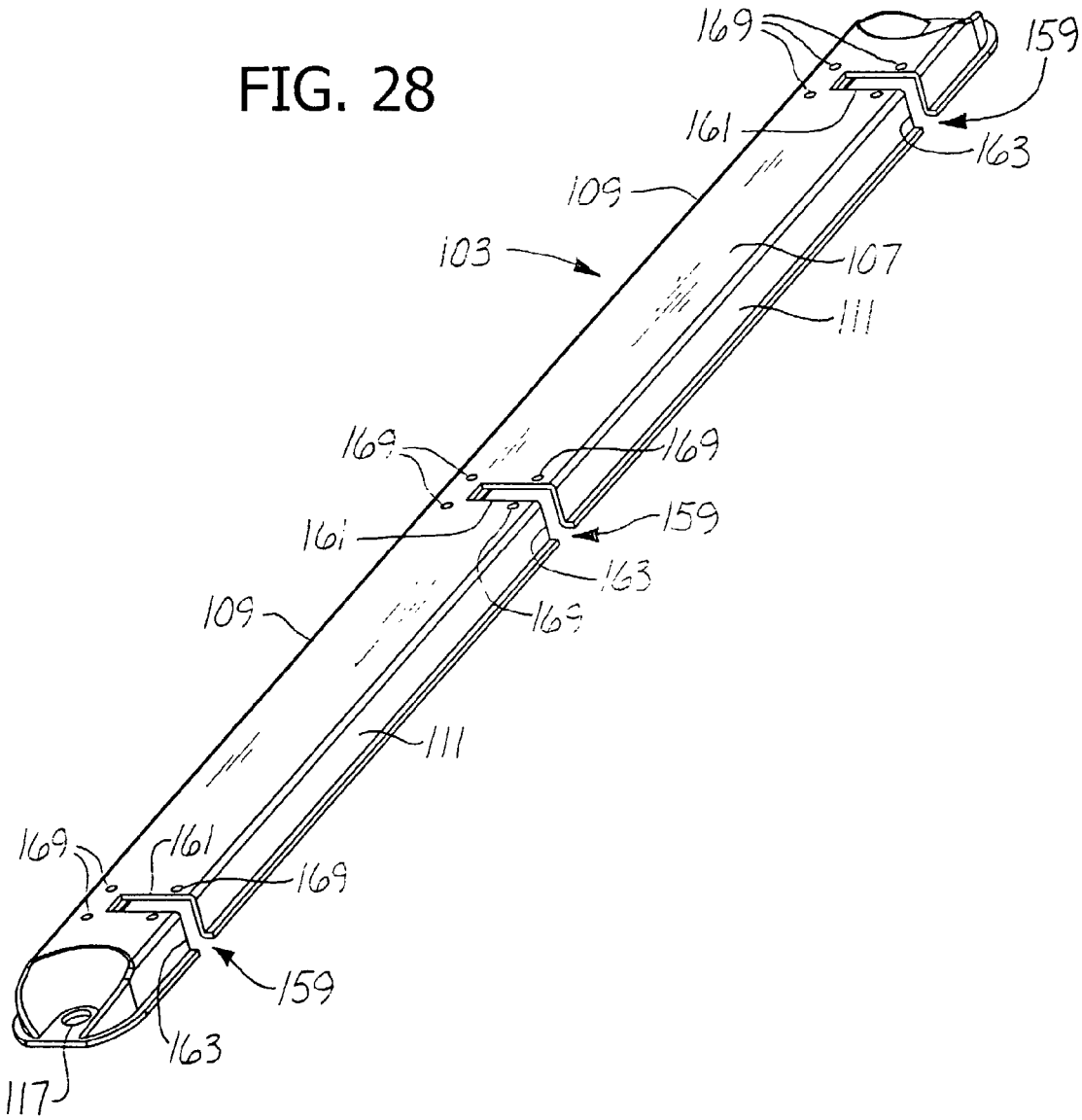
FIG. 28 is a top perspective of the spine per se of the FIG. 21 ring binder.
Figure 29:
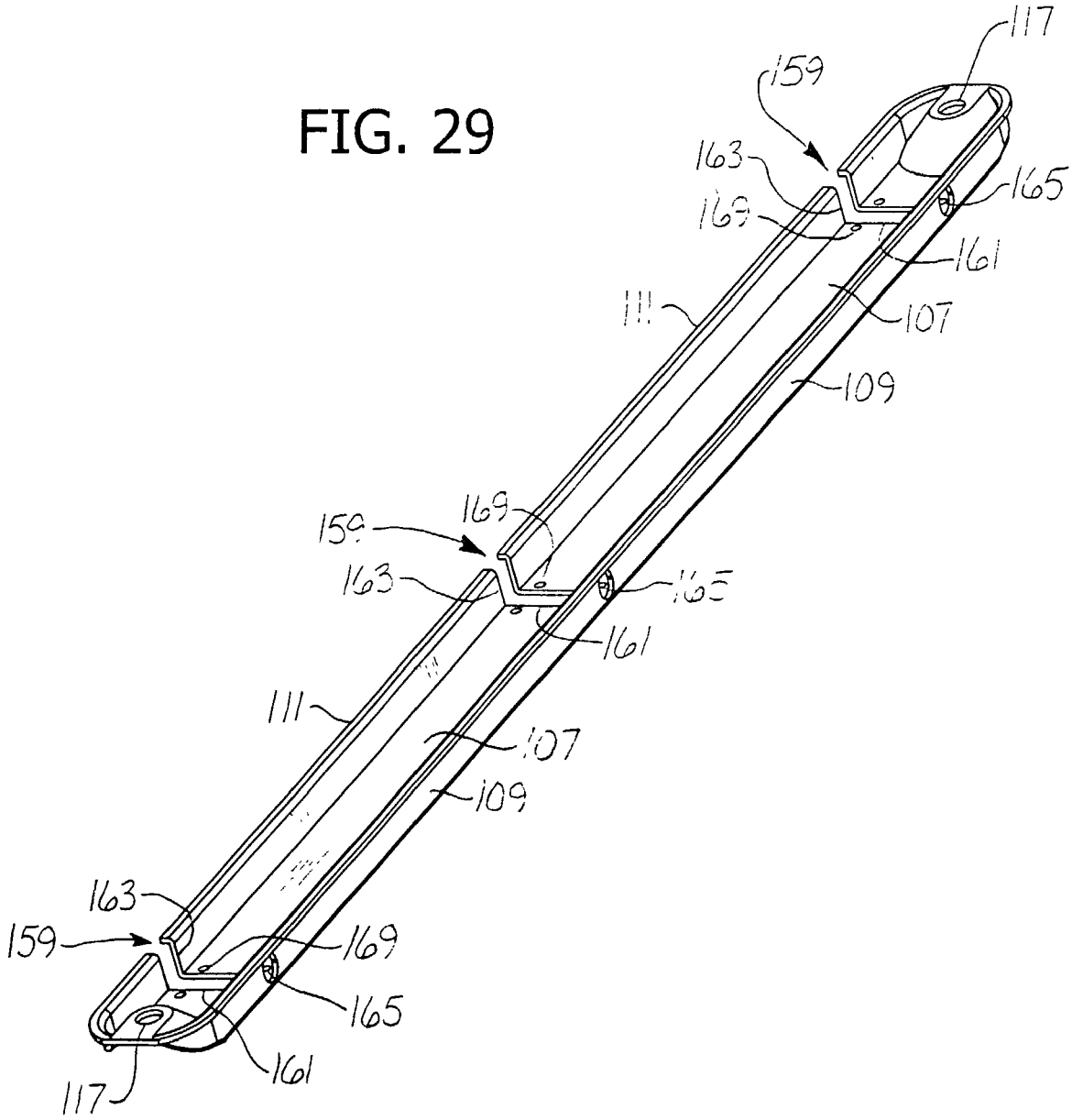
FIG. 29 is a bottom perspective of FIG. 28.

Like the ring binder 1, the ring binder 101 has three of the ring-forming constituents 105, one adjacent the upper end of the spine 103, one in the middle, one adjacent the lower end. Here again, the number is subject to variation. Each of the ring-forming constituents comprises a flexible strap 119, shown as being of generally elliptical cross-section with a flat top aspect 119*a* having a series of raked-back ratchet teeth 120 thereon extending lengthwise thereof. The toothed aspect is referred to as the top of the strap (being on top as the strap extends linearly) or as the inside of the strap (being on the inside as the strap is formed into a ring). Each of the straps has a clasp 121, here again more particularly a buckle, at one end (its left end as shown in FIGS. 21 and 22). The strap extends to the right from the clasp 121 (the buckle) and has a free end portion 123 ending in a tapered end 125. It is adapted to have the free end portion 123 laced through holes in loose-leaf items (again 29) to be bound and formed into a ring R by inserting said free end portion 123 in the clasp (buckle) 121 for holding it therein.

The free end portion 123 of the strap 119 is insertable to different positions in the clasp (buckle) 121 for forming rings R of different size (different diameter). The clasp (buckle) 121 holds the strap 119 against retrograde movement. The clasp or buckle 121 comprises a two-part body designated 131 in its entirety in the form of a rectangular frame having sides designated 133 and 135 and opposite ends 137 and 139 bounding a slot-like opening 141 extending endwise in the direction from end 137 to end 139 located generally centrally between sides 133 and 135. As illustrated, end 137 is at the left, 139 at the right. The left end 137 may be denoted the rearward or strap entry end of the buckle 121, the right end 139 may be denoted the forward or strap exit end of the buckle 121. The strap 119 extends generally from the center of the forward (i.e. the right or strap exit) end 139. Here again, the strap may be formed of various (including flat) cross-sections. The two-part body or frame 131 has a total thickness generally equal to the depth of the channel-section spine 103 for fitting therein as will be made clear.

The body or frame 131 has an opening 143 constituting a passage for strap 119 therethrough from end 137 (the strap entry end) to end 139 (the strap exit end). This passage 143 is located directly below the slot 141, the latter opening down into the passage, which is in the plane of and in registration with the slot. The body or frame 131 comprises a rectangular upper part generally designated 145 and a rectangular lower part or base 147, the passage 143 generally being half 143*a* in the upper part, half 143*b* in the lower part or base. Although the body or frame 131 has two parts 145,147, it is understood that the body or frame 131 may be formed of one, integral part or any number of parts without departing from the scope of this invention. The upper part 145 has a downwardly opening recess generally designated 149 in which the base 147 is fitted and secured. The sides of the recess 149 and the base 147 are stepped as indicated at 151, the half 143*a* of passage 143 being at the bottom of slot 141, the half 143*b* being in the top of the base 147. The passage 143 is of slightly larger size than the strap 119 so that the strap has a slidable fit therein.

Figure 30:
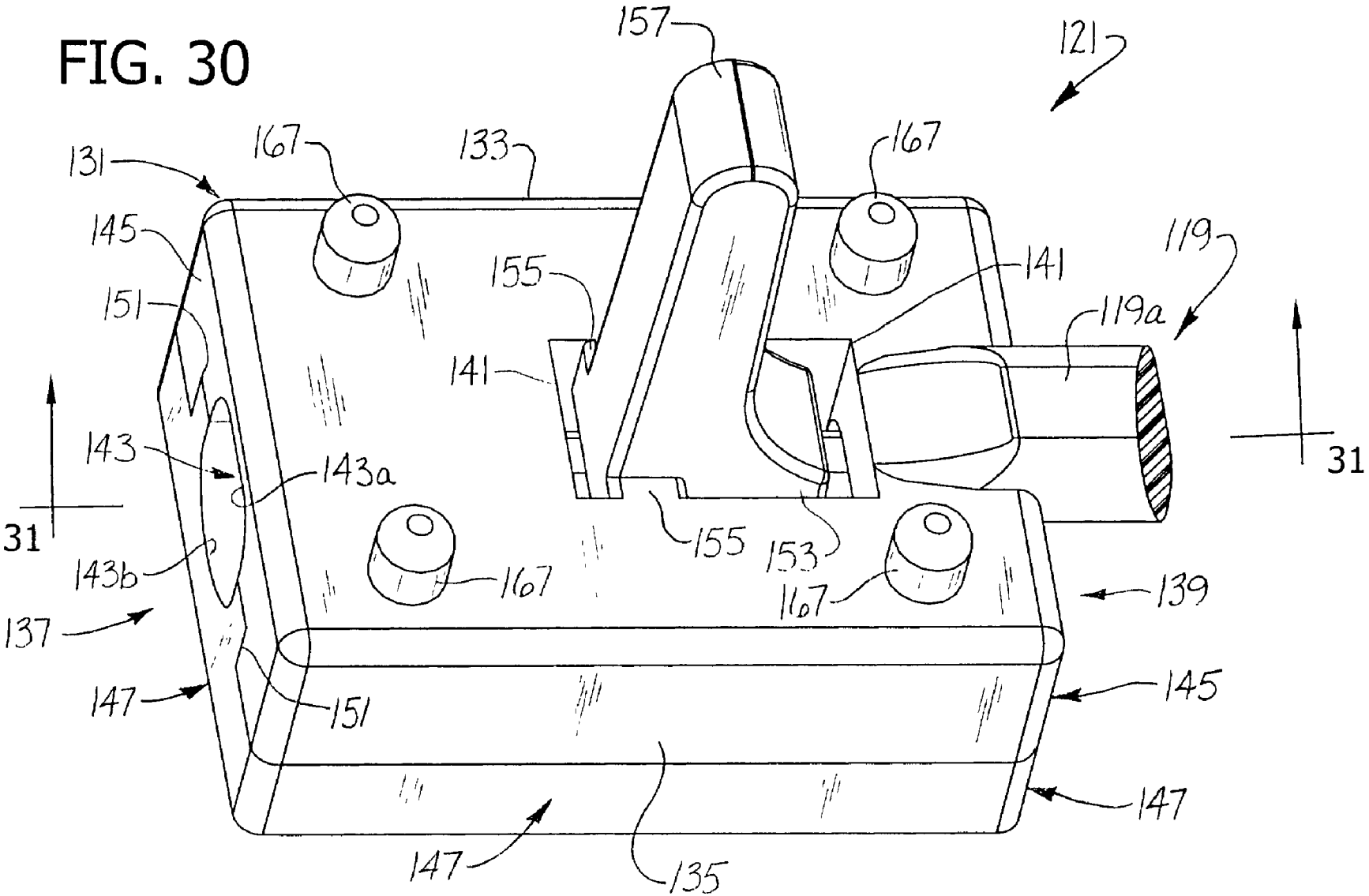
FIG. 30 is an enlarged top perspective of the clasp (buckle) of the FIG. 21 ring binder including a fragmentary fixed end portion of the strap.
Figure 32:
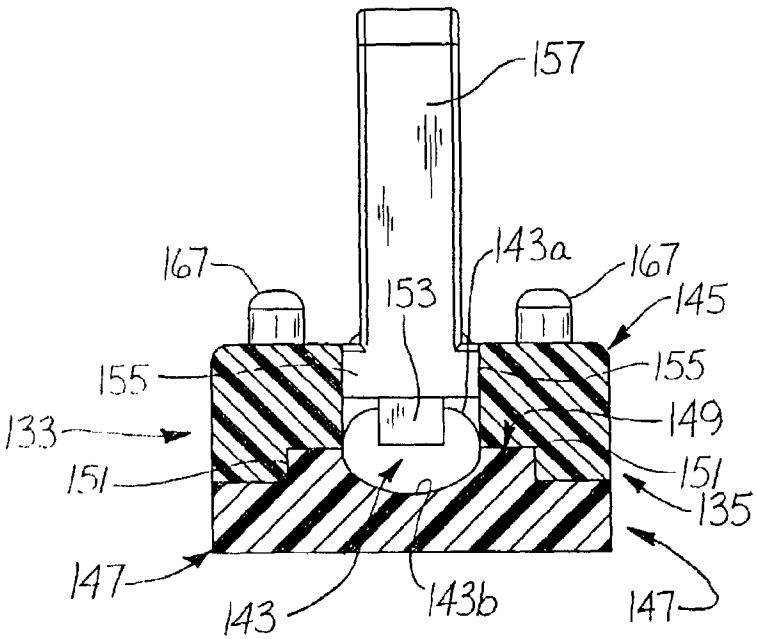
FIG. 32 is a view in section generally on line 32—32 of FIG. 31.
Figure 31:
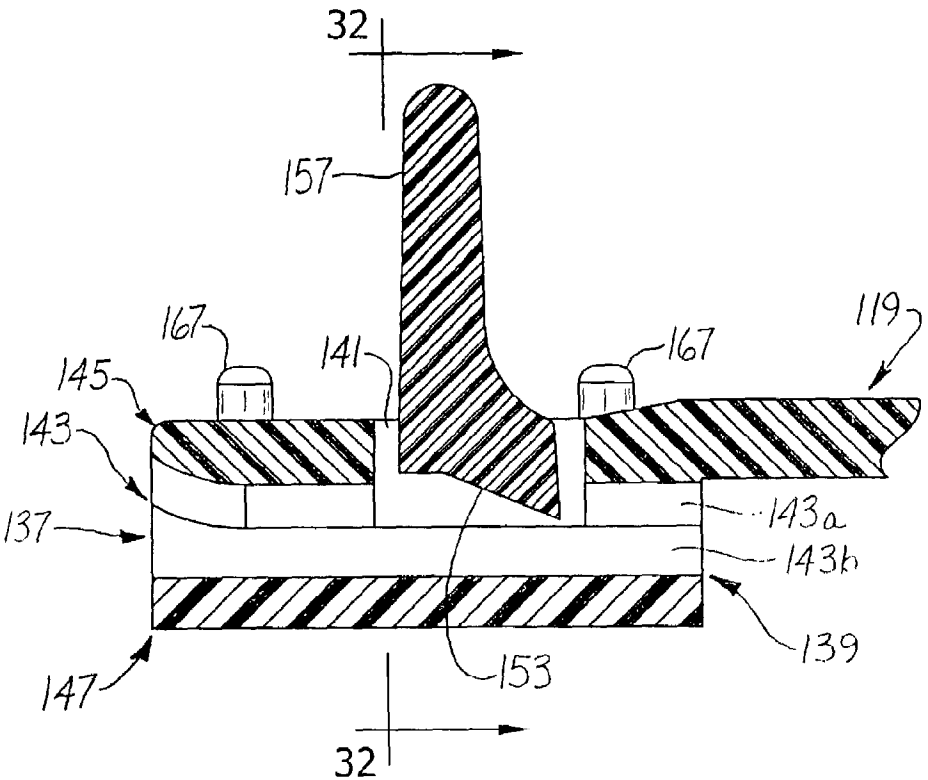
FIG. 31 is a view in section generally on line 31—31 of FIG. 30.
Figure 33:
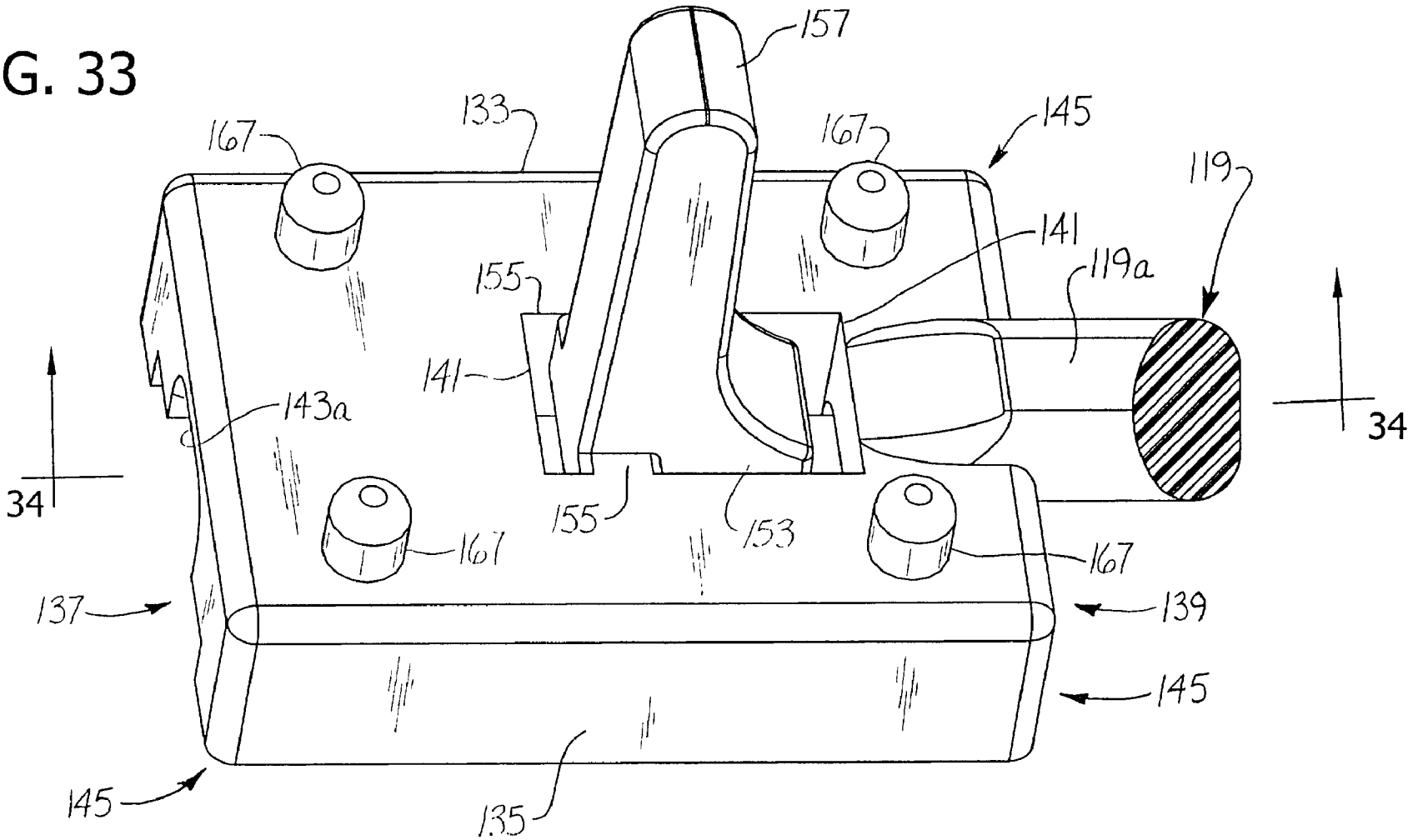
FIG. 33 is an enlarged top perspective of the upper part of the FIG. 21 clasp (buckle)
Figure 34:
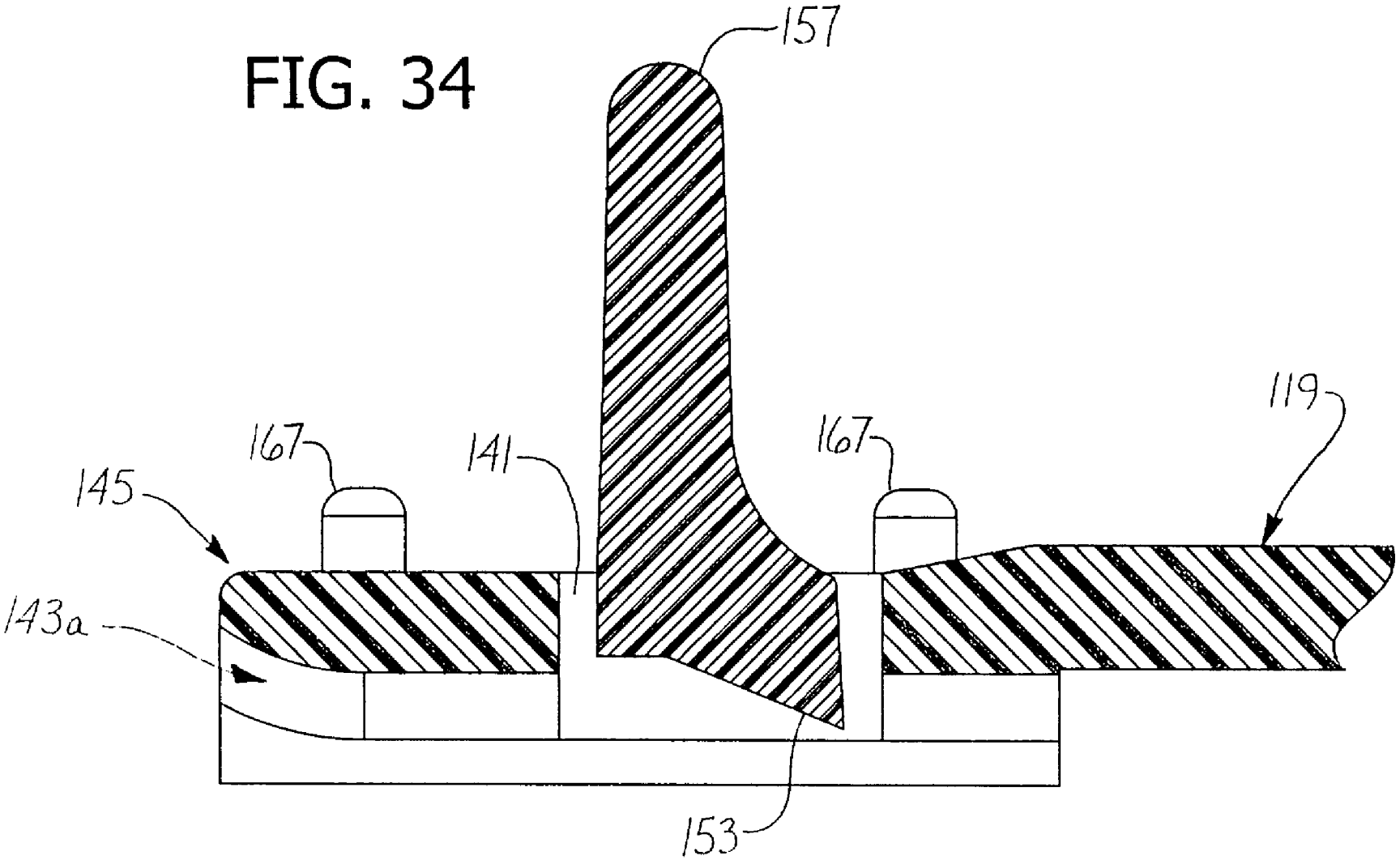
FIG. 34 is a view in section generally in section on line 34—34 of FIG. 33.
Figure 35:
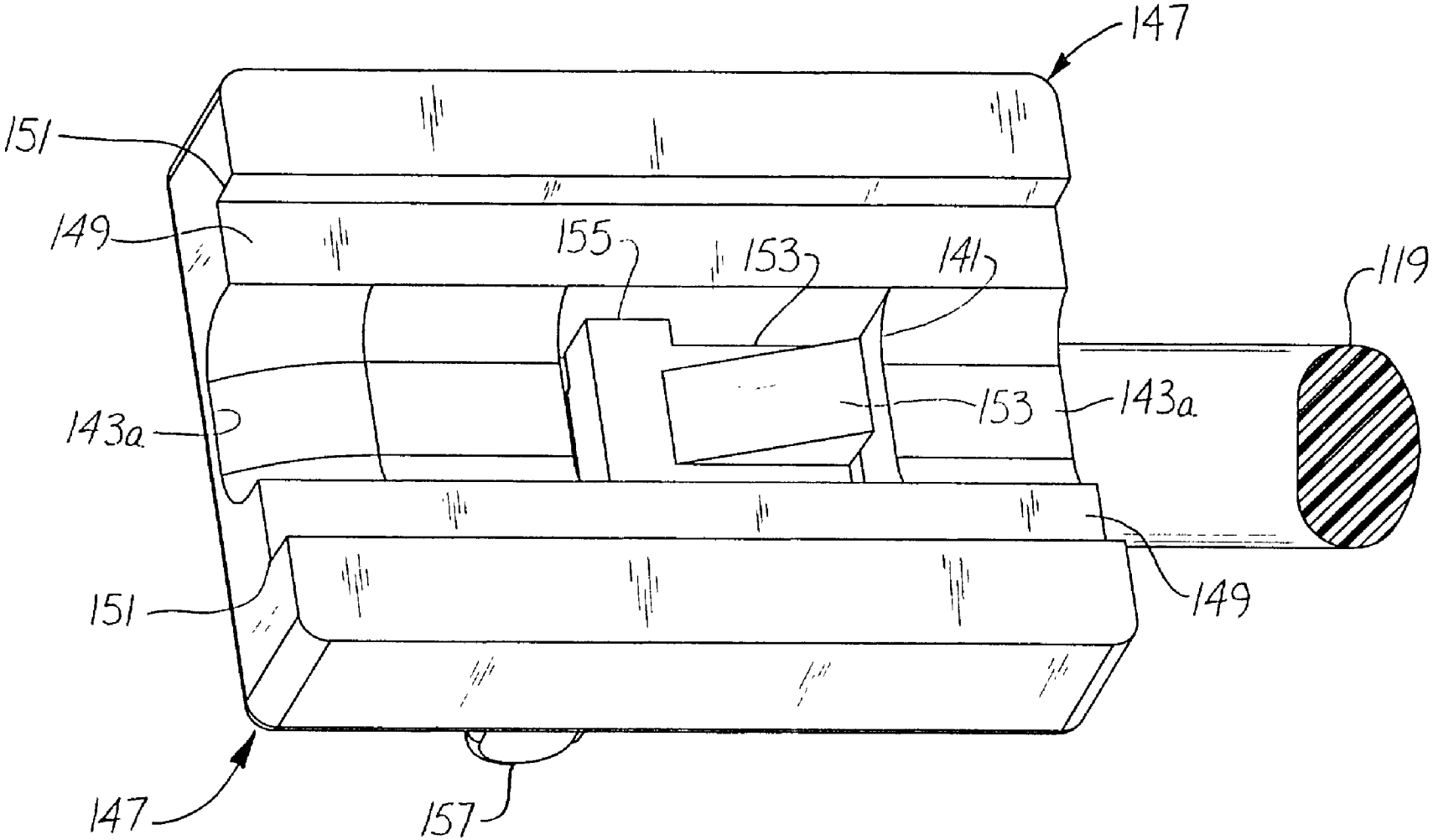
FIG. 35 is a bottom perspective of FIGS. 33 and 34.
Figure 36:
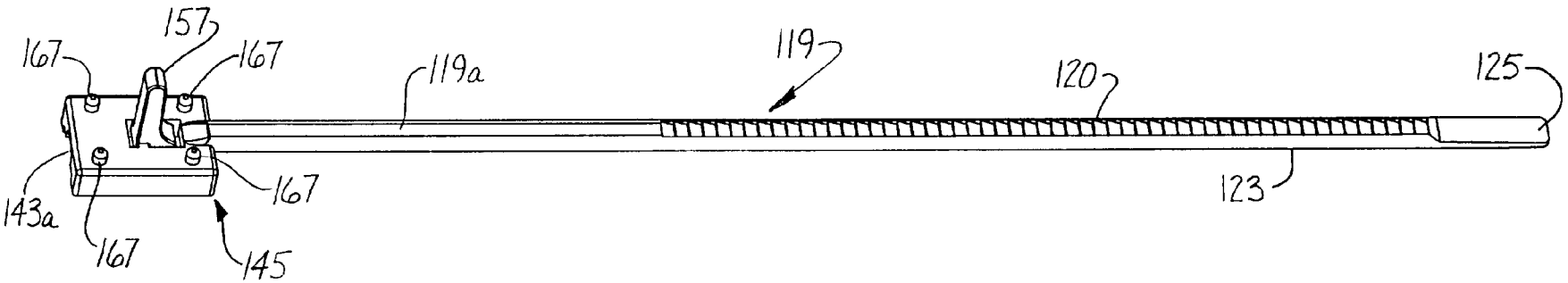
FIG. 36 is a top perspective of FIG. 33 plus the full length of the strap.
Figure 37:
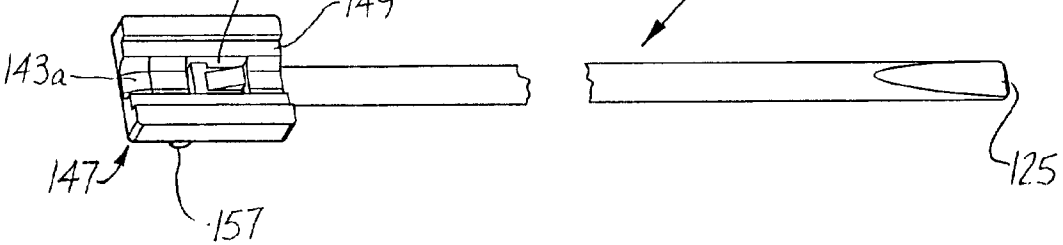
FIG. 37 is a fragmentary bottom perspective of FIG. 36.
Figure 42:
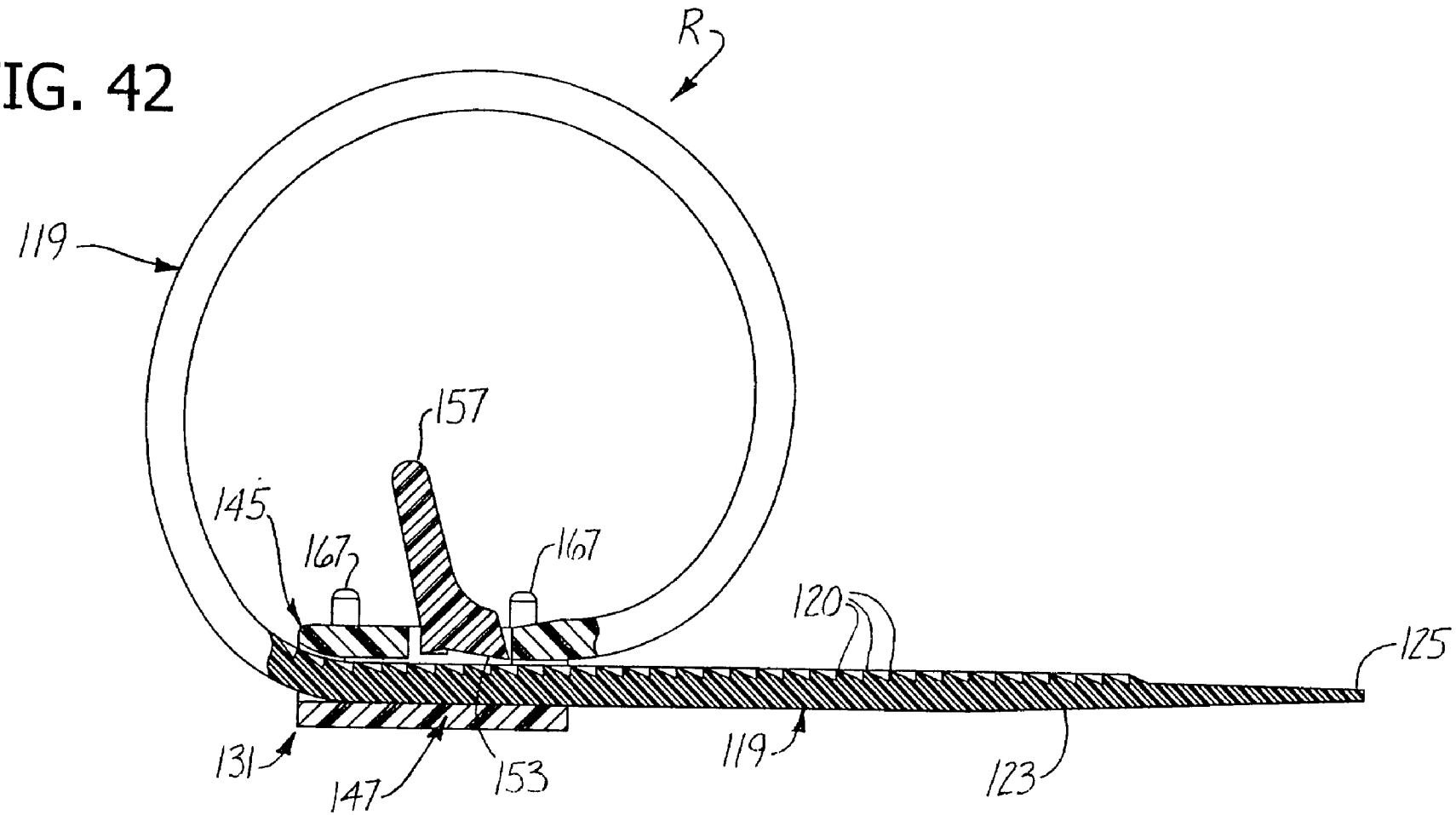
FIG. 42 is an enlargement of FIG. 39 showing how the strap is released for backing it off.
Figure 43:
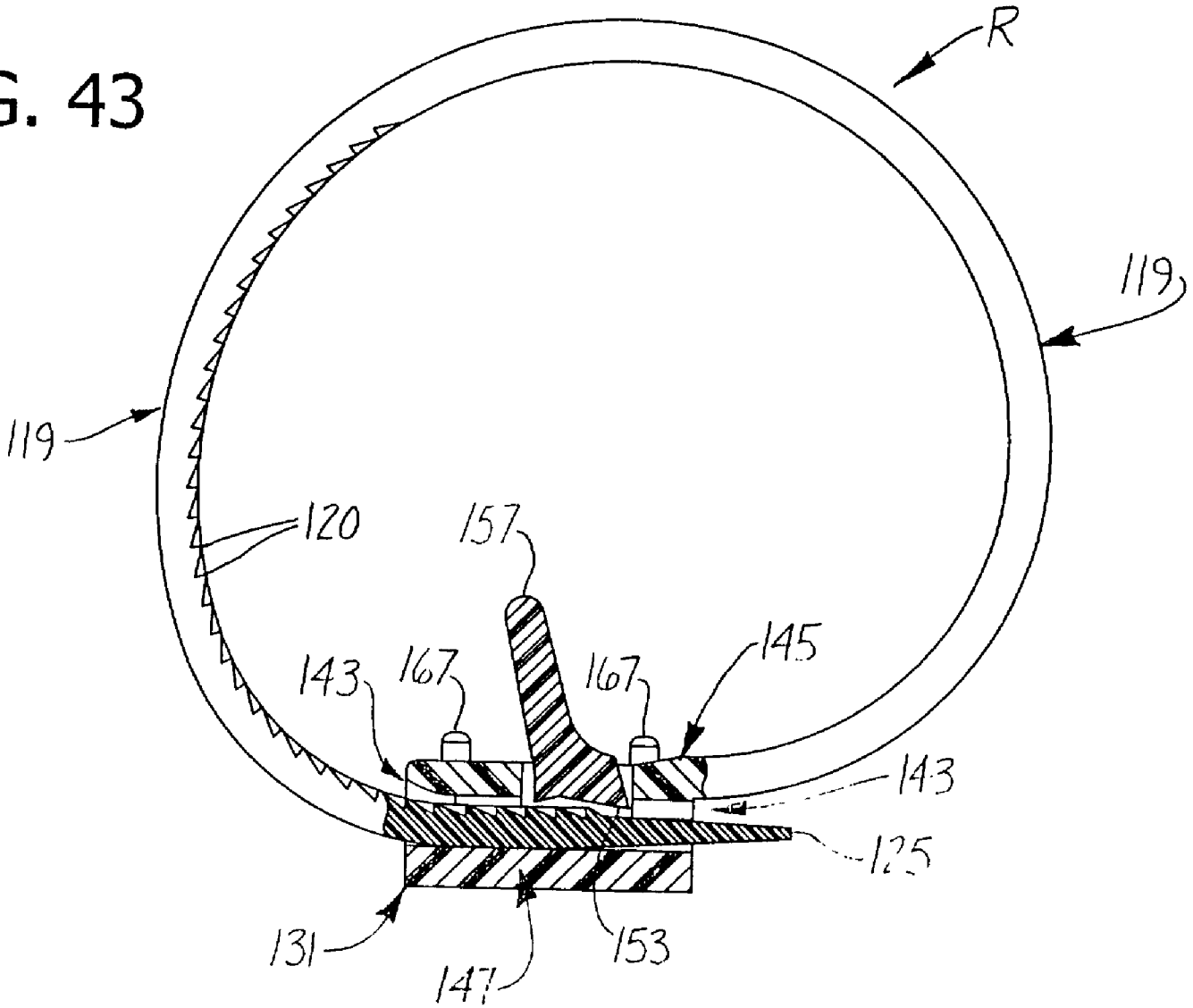
FIG. 43 is a development of FIG. 42 showing the strap backed off.
Figure 44:
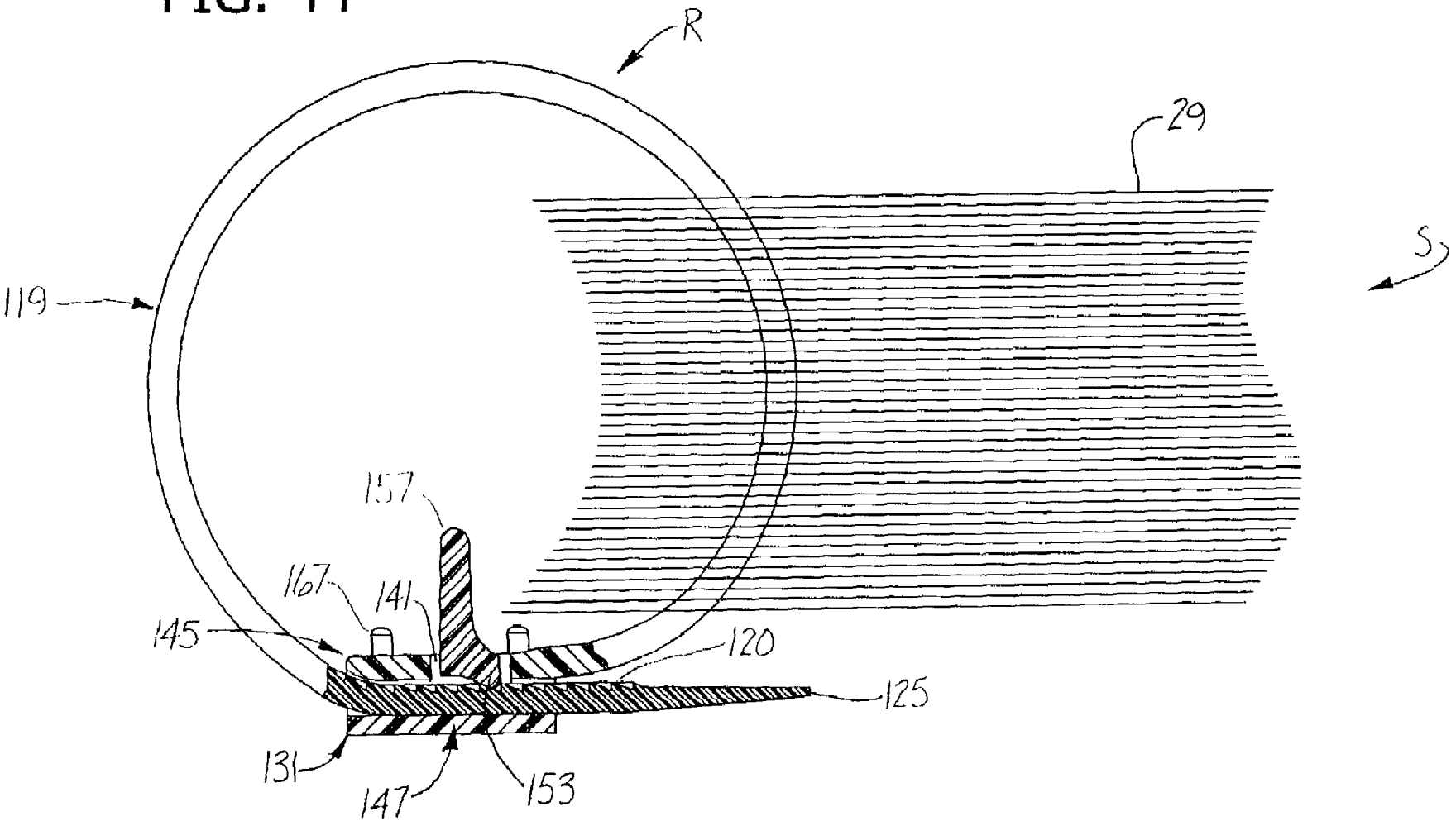
FIG. 44 is a view similar to FIG. 39 showing an intermediate size ring binding a sheaf of loose-leaf pages.

A relatively short resiliently acting arm constituting a pawl 153 extends forward in the slot 141 from a pair of lugs or supports each designated 155. Each of the lugs 155 is integral with the body 131 and the arm or pawl 153, these lugs extending transversely inward from opposite sides of the slot 141 adjacent the rearward end of the slot to junctures with the arm or pawl. The pawl 153 normally occupies the unbent relatively lowered position in which it is shown in FIGS. 30–32 for engagement with one of the raked-back ratchet teeth 120 on the strap 119 to hold the strap against retrograde movement. A lever 157 extending up from the rearward end of the pawl 153 is provided for being pulled back as shown in FIGS. 42–44 to bend the pawl up clear of the strap 119 to free the strap for retrograde movement in passage 143. Raising the pawl 153 involves bending up of the pawl from the ratchet-tooth-engaging position of FIGS. 30–32 et al. with resulted twisting of lugs 155 (counterclockwise as viewed in FIG. 33) thereby imposing a bias on the pawl tending to bend (swing) it back down to its ratchet-tooth-engaging position. To the extent that bending up the pawl 153 establishes a resilient effect at the junctures of the lugs and the arm or pawl 153 imposing the bias on the arm or pawl 153 for its springing back down, the latter may be regarded in a broad sense as a resiliently acting arm since it acts resiliently.

As noted, each ring-forming constituent 105 is preferably made of plastic material which lends itself to the resilient action of the arm or pawl 153. Here again, the strap 119 may be produced separately from the body 131 and suitably bonded thereto or molded integrally with the body.

The base or spine 103 has a plurality of sets of openings therein, each set being designated 159, one set for each clasp 121, at the stated spaced intervals along its length. Each set 159 comprises a slot 161 in the web 107 merging into a slot 163 in flange 111, and a hole 165 for entry of the strap 119 in flange 109, the hole 165 and slots 161 and 163 being coplanar. Each clasp 121 is fitted within the channel-section spine 103 with the top of the clasp generally in engagement with the web 107 and the ends 137 and 139 of the clasp generally in engagement with flanges 109 and 111. Pegs 167 extending up from the body of the clasp through holes 169 in the web 107 for positioning the clasp with lever 157 extending up through slot 161 in the web 107, strap 119 extending out through slot 163 in flange 111, and strap entry hole 165 in registration with the trailing end of passage 143. With the channel-section spine 103 fastened in place in a loose-leaf binder, the clasps 121 are held up in the spine by the loose-leaf binder.

Figure 38:
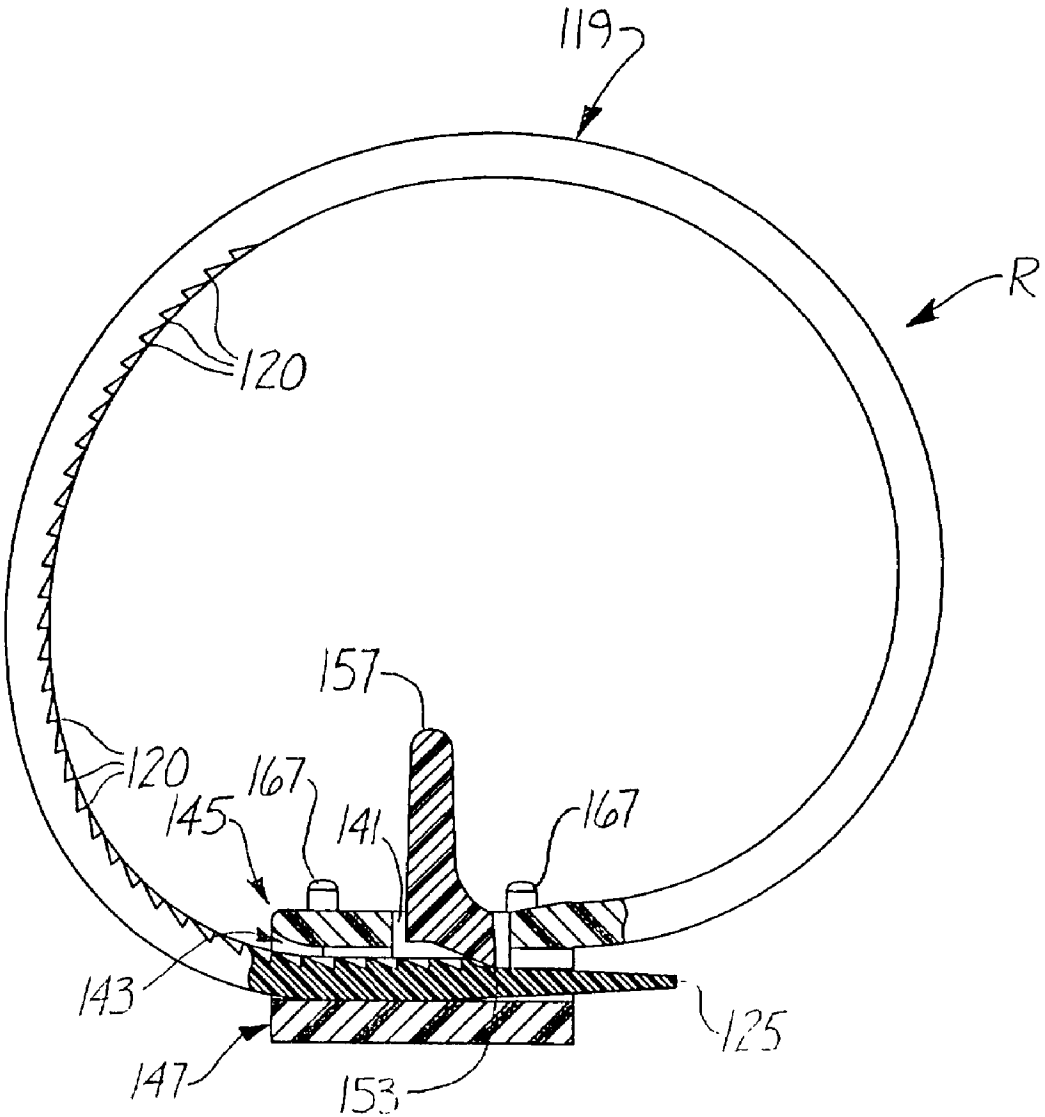
FIG. 38 is a view showing the clasp (buckle) of FIG. 21 in section and the incipient formation of a relatively large ring.
Figure 40:
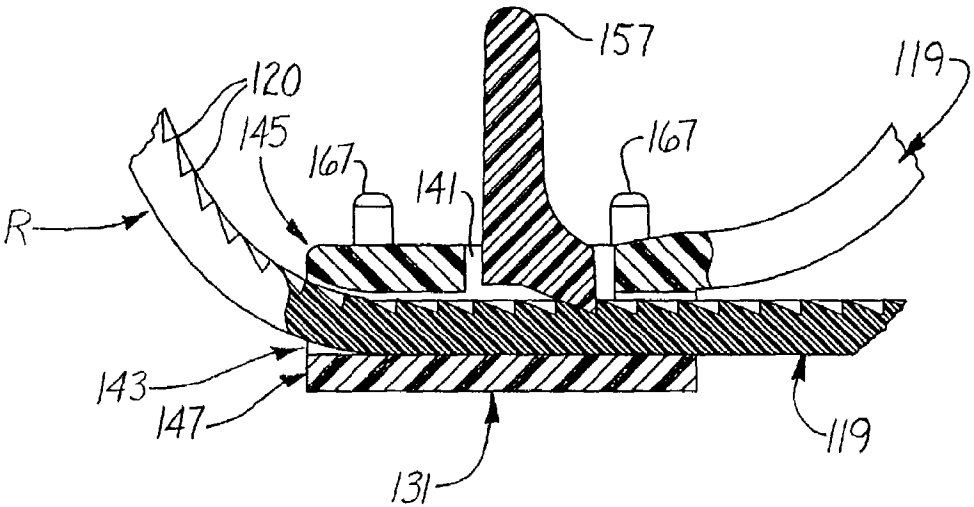
FIG. 40 is an enlargement of a fragment of FIG. 39.
Figure 39:
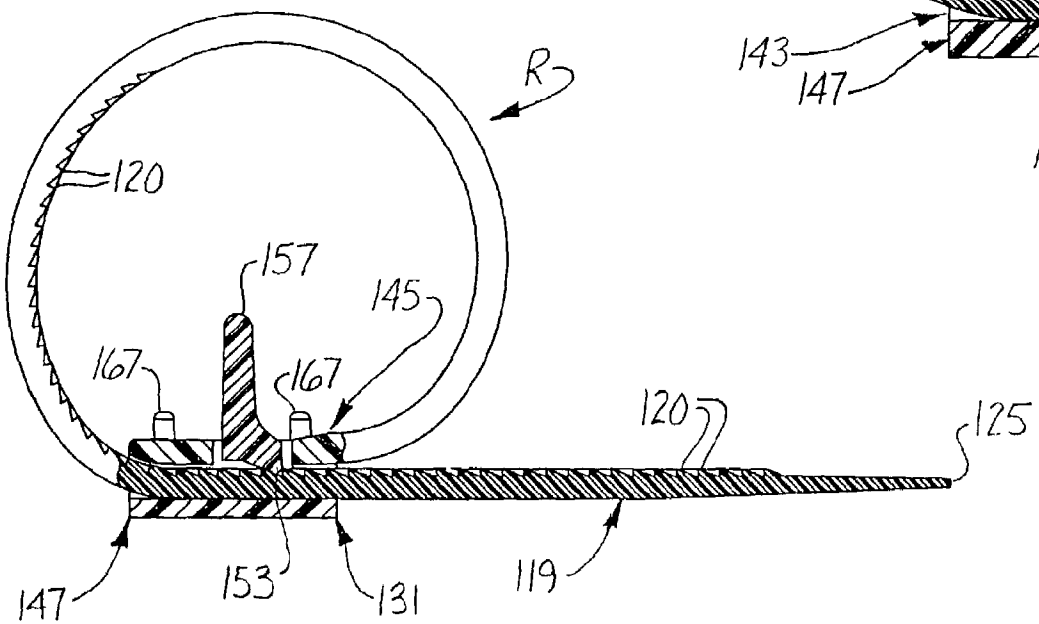
FIG. 39 is a view like FIG. 38 showing the formation of a relatively small ring.
Figure 41:
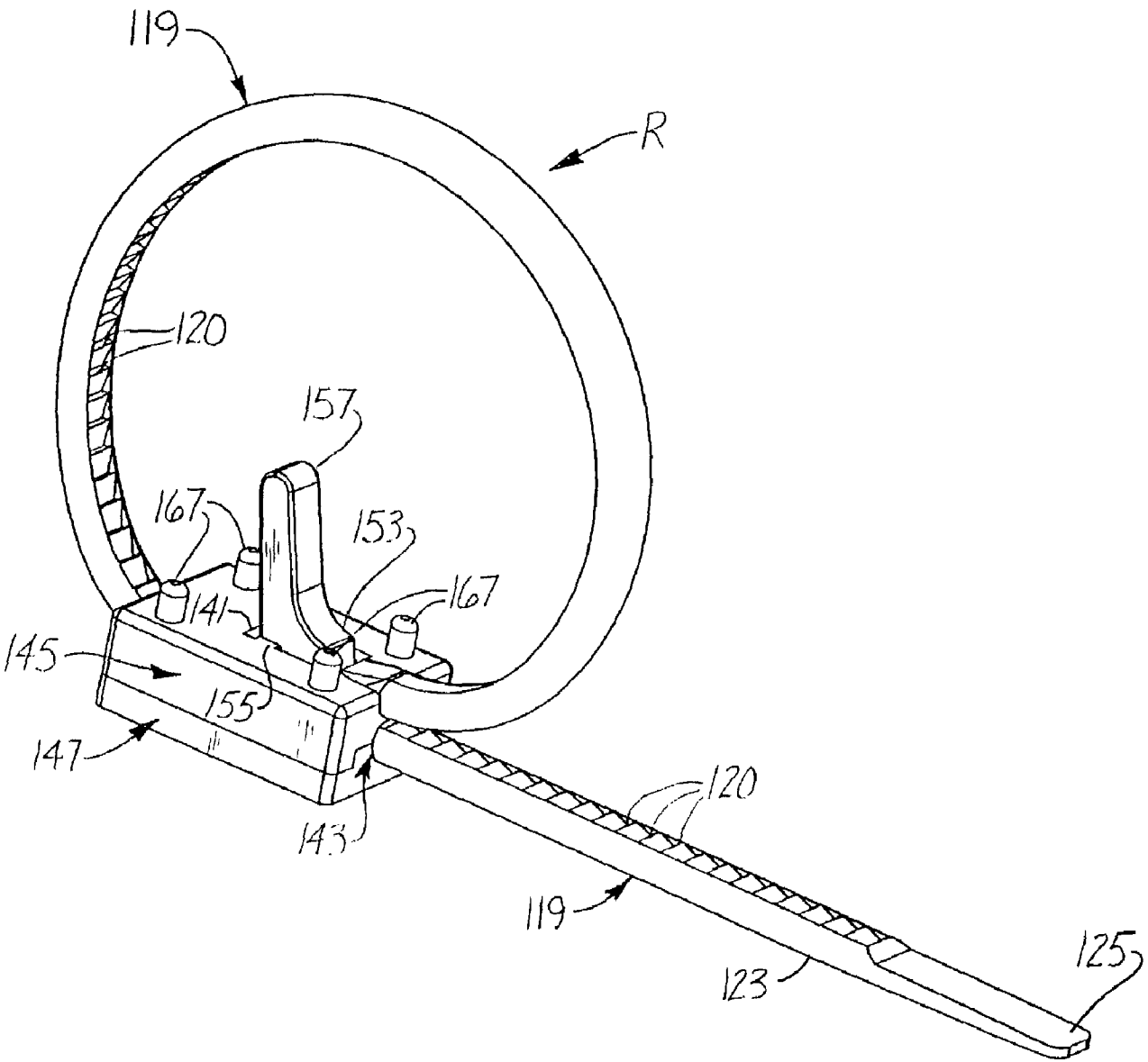
FIG. 41 is a perspective of FIG. 39 (relatively small ring)
Figure 45:
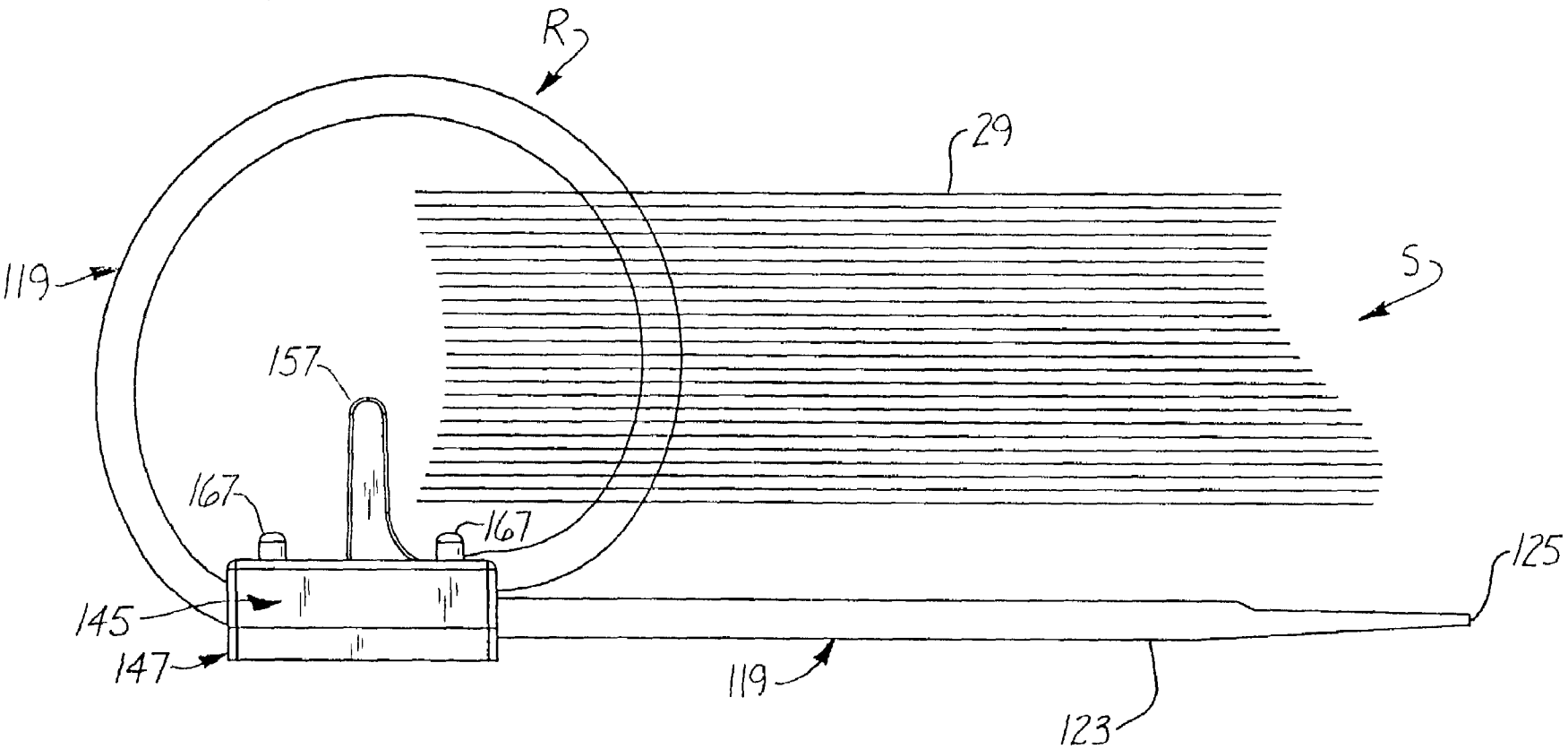
FIG. 45 is a view in elevation showing a relatively small-sized ring binding a sheaf.
Figure 47:
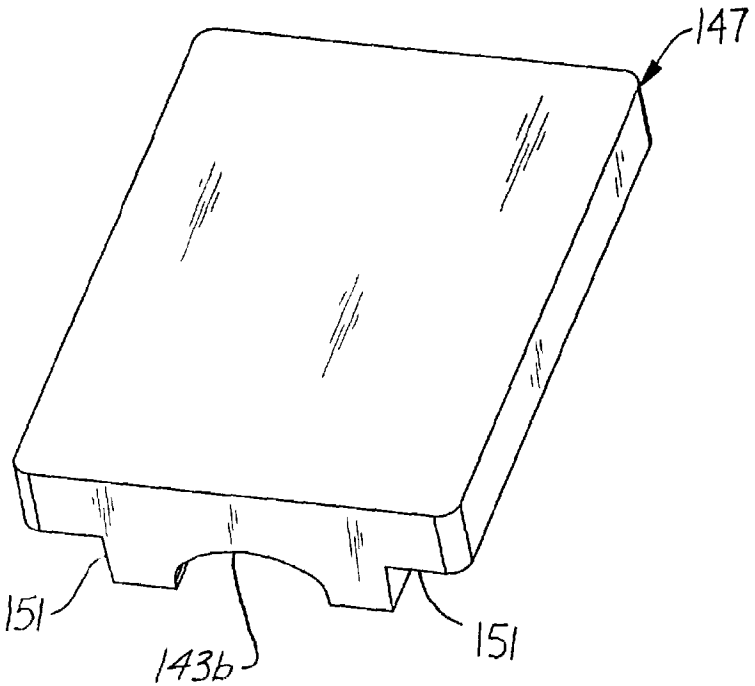
FIG. 47 is a bottom perspective of FIG. 46.
Figure 46:
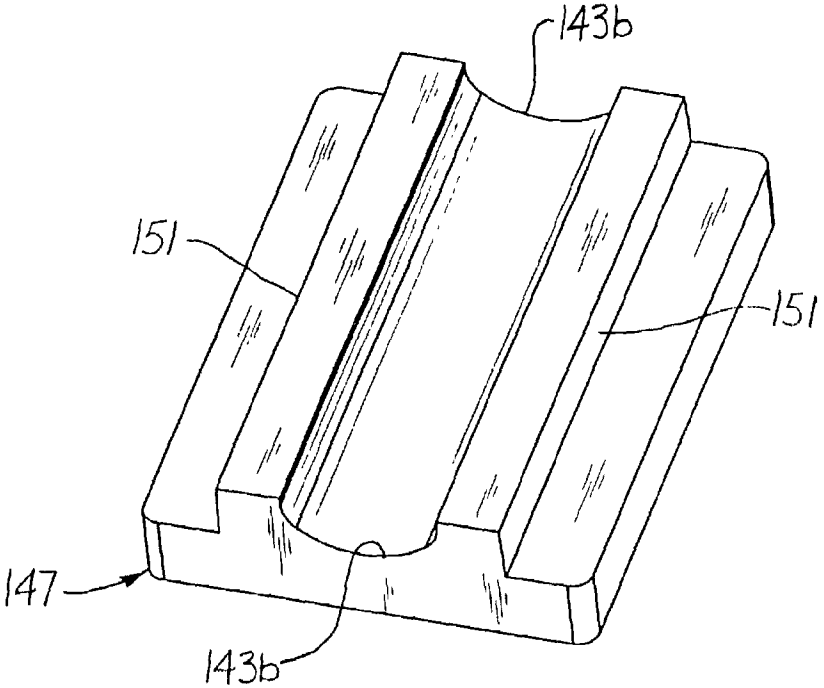
FIG. 46 is an enlarged top perspective of the lower part of the FIG. 21 clasp (buckle)

FIG. 38 shows the leading end portion 123 of the strap 119 entered in passage 143 of the clasp extending all the way through the clasp with its tapered end 125 just emerging from the passage. The pawl 153 is down in its unbent lowered position about to engage a ratchet tooth 120 of the strap 119 near the tapered end 125 for the formation of a relatively large size ring R such as shown in FIG. 44. The latter also illustrates the formation of the ring R after the lacing of the strap through the holes in the loose-leaf items 29 of a sheaf S thereof. The pawl 153 holds the strap against retrograde movement and establishes the ring R in a size depending on which ratchet tooth 120 the pawl engages. FIGS. 39, 40 and 45 illustrate a relatively small ring size. FIGS. 41–43 illustrate the release of the pawl 153 by the counterclockwise manipulation of the lever 157 for freedom of movement of the strap 119 in either direction, FIG. 43 illustrating how the ring size may be increased from the size shown in FIGS. 41 and 42.

As a modification, the strap 119 could be free of ratchet teeth but have holes as for the embodiment discussed above.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A ring binder having a plurality of ring-forming constituents each comprising a one-piece flexible strap having a clasp at one end and free of any hinge along its length, said strap extending from the clasp and having a free end portion, said strap being adapted to have its said free end portion laced through holes in loose-leaf items to be bound and formed into a ring by inserting said free end portion in the clasp for holding it in the clasp, the clasp comprising a resiliently acting arm engageable with the strap for holding the strap in the clasp, the clasp also comprising a buckle, the resiliently acting arm comprising a tongue of the buckle having a detent thereon engageable in a hole of a series of holes in the strap, the buckle comprising a plastic frame having rearward and forward ends, opposite sides, top and bottom, the strap extending from the forward end, the frame having an opening therein, and a lug extending down from the frame generally at an end of the opening, the resiliently acting arm extending from a position generally adjacent a lower end of the lug, the ring binder further comprising strap guides on the bottom of the frame including a rearward strap guide positioned rearward of the opening and a forward strap guide positioned forward of the opening.

2. A ring binder as set forth in claim 1 wherein said free end portion of the strap is insertable to different positions in the clasp for forming rings of different sizes.

3. A ring binder as set forth in claim 2 wherein the clasp holds the strap against retrograde movement from the position of the free end portion in the clasp.

4. A ring binder as set forth in claim 3 wherein the clasp allows forward movement of the strap for decreasing the size of the ring.

5. A ring binder as set forth in claim 2 wherein the clasp holds the strap against both retrograde and forward movement from the position of the free end portion in the clasp.

6. A ring binder as set forth in claim 1 wherein the resiliently acting arm comprises a pawl engageable with a ratchet tooth of a series of ratchet teeth on the strap.

7. A ring binder as set forth in claim 1 wherein the arm has a depressor extending up therefrom through said opening for bending the arm down, the upper end of the depressor being above the top of the frame.

8. A ring binder as set forth in claim 1 wherein the detent has a slanting surface engageable by the strap for camming the arm down.

9. A ring binder as set forth in claim 1 wherein each strap guide comprises a generally U-shaped protuberance, the opening in the rearward protuberance constituting a rearward guide opening and the opening in the forward protuberance constituting a forward guide opening.

10. A ring binder as set forth in claim 1 in combination with a loose-leaf binder.

11. A ring binder comprising an elongate bar constituting a spine of the ring binder, said bar having an upper face and provided with holes for receiving fasteners for fastening it in a loose-leaf binder, a plurality of ring-forming constituents mounted on the bar spaced along its length each comprising a flexible strap having a clasp at one end, each clasp being seated in a recess in the upper face of the bar, each strap extending from the clasp away from one side of the bar and having a free end portion, the ring binder being adapted to have the flexible straps laced through holes in loose-leaf items to be bound and formed into a ring by inserting said free end portion in the clasp for holding it in the clasp, the clasp comprising a resiliently acting arm engageable with the strap for holding the strap in the clasp, the clasp also comprising a buckle, the resiliently acting arm comprising a tongue of the buckle having a detent thereon engageable in a hole of a series of holes in the strap, the buckle comprising a plastic frame having rearward and forward ends, opposite sides, top and bottom, the strap extending from the forward end, the frame having an opening therein, and a lug extending down from the frame generally at an end of the opening, the resiliently acting arm extending from a position generally adjacent a lower end of the lug, the ring binder further comprising strap guides on the bottom of the frame including a rearward strap guide positioned rearward of the opening and a forward strap guide positioned forward of the opening.

12. A ring binder as set forth in claim 11 wherein said free end portion of the strap is insertable to different positions in the clasp for forming rings of different sizes.

13. A ring binder as set forth in claim 12 wherein the clasp holds the strap against retrograde movement from the position of the free end portion in the clasp.

14. A ring binder as set forth in claim 13 wherein the clasp allows forward movement of the strap for decreasing the size of the ring.

15. A ring binder as set forth in claim 12 wherein the clasp holds the strap against both retrograde and forward movement from the position of the free end portion in the clasp.

16. A ring binder as set forth in claim 11 wherein the resiliently acting arm comprises a pawl engageable with a ratchet tooth of a series of ratchet teeth on the strap.

17. A ring binder as set forth in claim 11 wherein the arm has a depressor extending up therefrom through said opening for bending the arm down, the upper end of the depressor being above the top of the frame.

18. A ring binder as set forth in claim 11 wherein the detent has a slanting surface engageable by the strap for camming the arm down.

19. A ring binder as set forth in claim 11 wherein each strap guide comprises a generally U-shaped protuberance, the opening in the rearward protuberance constituting a rearward guide opening and the opening in the forward protuberance constituting a forward guide opening.

20. A ring binder as set forth in claim 19 wherein said bar has a rectangular cross section.

21. A ring binder as set forth in claim 11 in combination with a loose-leaf binder.

22. A ring binder comprising an elongate bar constituting a spine of the ring binder, said bar having an upper face and provided with holes for receiving fasteners for fastening it in a loose-leaf binder, a plurality of ring-forming constituents mounted on the bar spaced along its length each comprising a flexible strap having a clasp at one end, each clasp being seated in a recess in the upper face of the bar, each strap extending from the clasp away from one side of the bar and having a free end portion, the ring binder being adapted to have the flexible straps laced through holes in loose-leaf items to be bound and formed into a ring by inserting said free end portion in the clasp for holding it in the clasp, said free end portion of the strap being insertable to different positions in the clasp for forming rings of different sizes, the clasp holding the strap against retrograde movement from the position of the free end portion in the clasp and allowing forward movement of the strap for decreasing the size of the ring, wherein the clasp has a resiliently acting arm engageable with the strap for holding the strap in the clasp, the resiliently acting arm comprising a tongue having a detent thereon engageable in a hole of a series of holes in the strap, the detent having a slanting surface engageable by the strap for camming the arm down, and wherein the clasp comprises a plastic frame having rearward and forward ends, opposite sides, top and bottom, the strap extending from the forward end, the frame having an opening therein, a lug extending down from the frame at an end of the opening, the resiliently acting arm extending from a position generally adjacent a lower end of the lug, the arm having a depressor extending up therefrom through said opening for bending the arm down, the upper end of the depressor being above the top of the frame, and strap guides each comprising a generally U-shaped protuberance on the bottom of the frame including a rearward strap guide positioned rearward of the opening and a forward strap guide positioned forward of the opening.

23. A ring binder comprising an elongate spine having first and second sides and holes for receiving fasteners for fastening the spine in a loose-leaf binder, a plurality of ring-forming constituents carried by the spine at spaced intervals along its length each comprising a one-piece flexible strap having a clasp at one end and free of any hinge along its length, each clasp being situated generally within the spine with the respective strap extending from the clasp through an opening in the second side of the spine, the strap having a free end portion adapted to be laced through holes in loose-leaf items to be bound and formed into a ring by inserting said free end portion through a hole in the first side of the spine and thence through the clasp for being held in the clasp, said spine comprising an elongate channel having a web constituting a top of the spine and first and second flanges extending down from opposite side edges of the web constituting the first and second sides of the spine, the clasp having a resiliently acting arm engageable with the strap for holding the strap in the clasp, the resiliently acting arm comprising a pawl engageable with a ratchet tooth of a series of ratchet teeth on the strap.

24. A ring binder as set forth in claim 23 wherein the pawl has a lever extending up through an opening in the web for operation of the pawl.

25. A ring binder as set forth in claim 24 wherein the pawl extends forward in the opening in the web from lugs which extend transversely inward from opposite sides of the opening in the web.

26. A ring binder as set forth in claim 25 wherein the clasp has a passage for the strap extending lengthwise therethrough below the opening in the web.

27. A ring binder as set forth in claim 26 wherein the clasp, including the pawl and the strap are plastic.

28. A ring binder as set forth in claim 23 in combination with a loose-leaf binder.

* * * * *